US006573021B2

(12) United States Patent
Baker et al.

(10) Patent No.: US 6,573,021 B2
(45) Date of Patent: Jun. 3, 2003

(54) HIGH CONTRAST PHOTOGRAPHIC ELEMENT CONTAINING A NOVEL COMBINATION OF NUCLEATORS

(75) Inventors: Julie Baker, Hertfordshire (GB); Ian Barford, Hertfordshire (GB); Philip J. Coldrick, Twickenham (GB); Dawn J. Jenkins, Buckinghampshire (GB); Roger H. Piggin, Hertfordshire (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/040,672

(22) Filed: Jan. 7, 2002

(65) Prior Publication Data

US 2002/0192589 A1 Dec. 19, 2002

(30) Foreign Application Priority Data

Feb. 6, 2001 (GB) ..... 0102880

(51) Int. Cl.[7] ..... G03C 1/295; G03C 5/308
(52) U.S. Cl. ..... 430/264; 430/265; 430/598
(58) Field of Search ..... 430/264, 598, 430/265

(56) References Cited

U.S. PATENT DOCUMENTS

| | | | | |
|---|---|---|---|---|
| 4,030,925 A | | 6/1977 | Leone et al. | 430/264 |
| 4,031,127 A | | 6/1977 | Leone et al. | 430/264 |
| 4,269,929 A | | 5/1981 | Nothnagle | 430/264 |
| 4,278,748 A | | 7/1981 | Sidhu et al. | 430/598 |
| 4,323,643 A | | 4/1982 | Mifune et al. | 430/598 |
| 4,668,605 A | | 5/1987 | Okutsu et al. | 430/267 |
| 4,740,452 A | | 4/1988 | Okutsu et al. | 430/265 |
| 4,975,354 A | | 12/1990 | Machonkin et al. | 430/264 |
| 4,988,604 A | | 1/1991 | Machonkin et al. | 430/264 |
| 4,994,365 A | | 2/1991 | Looker et al. | 430/264 |
| 5,288,590 A | | 2/1994 | Kuwabara et al. | 430/264 |
| 5,316,889 A | | 5/1994 | Sakai | 430/264 |
| 5,328,801 A | | 7/1994 | Yasuda et al. | 430/264 |
| 5,744,279 A | | 4/1998 | Ezoe et al. | 430/264 |
| 5,882,841 A | | 3/1999 | Ezoe et al. | 430/264 |
| 6,063,541 A | * | 5/2000 | Watson | 430/264 |
| 6,143,462 A | * | 11/2000 | Goddard et al. | 430/264 |
| 6,245,480 B1 | * | 6/2001 | Bogie et al. | 430/264 |

FOREIGN PATENT DOCUMENTS

| | | |
|---|---|---|
| EP | 0 333 435 A3 | 9/1989 |
| EP | 0 333 435 A2 | 9/1989 |
| EP | 0 364 166 A3 | 4/1990 |
| EP | 0 364 166 A2 | 4/1990 |
| EP | 1 008 902 A1 | 6/2000 |

* cited by examiner

*Primary Examiner*—Richard L. Schilling
(74) *Attorney, Agent, or Firm*—Arthur E. Kluegel

(57) ABSTRACT

The invention relates to an ultrahigh contrast photographic material comprising a support bearing a silver halide emulsion layer, containing a combination of two or more hydrazide nucleating agents in the emulsion layer and/or a hydrophilic colloid layer, characterized in that the combination comprises a nucleating agent(s) of formulae (I) and/or (I) with a nucleator of formula (III), in which the nucleating agent of formula (I) comprises (a) two nicotinamide moieties, which may be the same or different, which are linked by a linking group, and (b) a hydrazide moiety linked to only one of those nicotinamide moieties; the nucleating agent of formula (II) comprises a dimeric molecule comprising two monomers linked by a linking group, each monomer of which (a) may be the same or different and (b) comprises a hydrazide moiety and a nicotinamide moiety; and the nucleating agent of formula (III) comprises an aryl sulfonamido aryl hydrazide.

The combination of nucleating agents show less sensitivity to variation in the development conditions than do the individual nucleating types, leading to significant improvements in processing robustness with less change in image quality with processing and tolerance to a wider range of developer solutions.

20 Claims, No Drawings

HIGH CONTRAST PHOTOGRAPHIC ELEMENT CONTAINING A NOVEL COMBINATION OF NUCLEATORS

FIELD OF THE INVENTION

This invention relates to high contrast photographic silver halide materials containing a combination of hydrazide nucleating agents and in particular to those materials of the graphic arts type.

BACKGROUND OF THE INVENTION

In the field of graphic arts, an ultrahigh contrast photographic material is required for achieving satisfactory halftone dot reproduction of a continuous tone or reproduction of a line image in the process of making a lithographic printing plate. For many years these ultrahigh contrast photographic images were obtained by developing a 'lith' emulsion (usually high in silver chloride content) in a hydroquinone, low sulphite, 'lith' developer by the process known as infectious development. However, such low sulphite developers are inherently unstable and are particularly inappropriate for machine processing.

More recently an image formation system providing ultrahigh contrast where the gamma (contrast) exceeds 10 has been provided conventionally in a material wherein silver halide bearing a surface latent image is developed in the presence of a hydrazine (also known as a nucleating agent), specifically an acylhydrazine, which can be incorporated into the photographic material or into the developer. The pH of the developer solution is usually in the range 10.0 to 12.3, typically about 11.5, and the developer includes conventional amounts of sulphite, hydroquinone and possibly metol or a pyrazolidone. While such a process is better than the low sulphite 'lith' process, the developer still has a high pH requirement for it to function correctly. Such a solution is not as stable as is desirable. Additionally, high pH solutions are environmentally undesirable because of the care needed in handling and disposing of the effluent.

Unfortunately, light sensitive materials whose contrast is enhanced by the presence of a hydrazine nucleating agent show large variations in their photographic properties as the developer is exhausted or through the course of time, for example as the pH of the developer varies and in particular as the pH is lowered. The pH of the developer can vary for a number of reasons: for example, exhaustion and absorption of carbon dioxide causes the pH to drop whilst air oxidation causes the pH to rise, as can concentration through evaporation.

Also during development of silver halide materials, particularly those which use chlorobromide emulsions, there is a release of bromide locally into area of the development as a consequence of the development process to convert silver halide to elemental silver. Both of these effects can influence the development rate of the film and give rise to process unevenness or variability during the processing run. There is an overall effect that shows up as a change to the developer component levels in solution but there is also a local effect that occurs within the developing layer and is exposure dependent. These effects can also depend on the formulation of the developer used and overcoming these problems can increase tolerance to a wider range of developer formulations.

It is also known that a developer solution having a pH below 11 can be employed by using certain hydrazides active at this pH. Hydrazides proposed for such use are described, for example, in U.S. Pat. Nos. 4,278,748; 4,031,127; 4,030,925,4,323,643, 4,988,604 and 4,994,365 and in EP-A-0 333435. A nucleator containing both a hydrazide moiety and a nicotinamide moiety is disclosed in U.S. Pat. No. 5,288,590. However the use of these nucleating agents does not entirely remove sensitivity to both bromide and pH.

A nucleating agent which comprises a dimeric molecule comprising two monomers linked by a linking group, each monomer of which (a) may be the same or different and (b) comprises a hydrazide and a nicotinamide moiety has been disclosed in EP-A-1 008 902. A nucleating agent comprising (a) two nicotinamide moieties, which may be the same or different, which are linked by a linking group, and (b) a hydrazide moiety linked to only one of those nicotinamide moieties, either alone or together with the nucleating agent comprising the dimeric molecule, has been described in EP Patent application No. 01201989.9. U.S. Pat. Nos. 4,988,604 and 4,994,365 describe aryl sulfonamidophenyl hydrazide nucleating agents that are capable of high contrast development.

Developer solutions with these low pHs can also be used by the introduction of a contrast-promoting agent (commonly called a booster) to give adequate activity. The booster can be incorporated into the photographic layer or may be dissolved in the developer solution. The booster may be, for example, one of the boosters as described in U.S. Pat. No. 5,316,889 or an amine booster as described in U.S. Pat. Nos. 4,269,929; 4,668,605, 4,740,452, 4,975,354 or EP-A-0 364166. Compounds bearing different functionalities e.g. phosphonium and pyridinium, have also been shown to be active, as described in U.S. Pat. No. 5,744,279.

The design of nucleators and boosters is continuing to develop by varying their structures to fine tune the performance of the system and to enhance image quality and process stability during the running of a process. U.S. Pat. No. 5,328,801 describes the use of an inhibitor releasing redox compound suitable for nucleated systems. The problems associated with processing unevenness are described in U.S. Pat. No. 5,882,841.

PROBLEM TO BE SOLVED BY THE INVENTION

The problem is therefore to provide nucleators for incorporation into a photographic material which has improved processing evenness through a reduced sensitivity to variations in the developer pH and bromide level which occur in the film during development and which exhibits greater tolerance to a wider range of developers.

It has been found that these objectives can be achieved by the use of a combination of nucleating agent(s) of formulae (I) and/or (II) with a nucleating agent of formula (III), in which the nucleating agent of formula (I) comprises (a) two nicotinamide moieties, which may be the same or different, which are linked by a linking group, and (b) a hydrazide moiety linked to only one of those nicotinamide moieties; the nucleating agent of formula (II) comprises a dimeric molecule comprising two monomers linked by a linking group, each monomer of which (a) may be the same or different and (b) comprises a hydrazide moiety and a nicotinamide moiety; and the nucleating agent of formula (III) comprises an aryl sulfonamido aryl hydrazide.

Such a combination of nucleating agents can lead to high contrast nucleation providing excellent processing evenness in a developer whose pH is variable and can give greater tolerance to a wide range of developer solutions.

SUMMARY OF THE INVENTION

According to the present invention therefore there is provided an ultrahigh contrast photographic material comprising a support bearing a silver halide emulsion layer, containing a combination of two or more hydrazide nucleating agents in the emulsion layer and/or a hydrophilic colloid layer, characterised in that the combination comprises a nucleating agent(s) of formulae (I) and/or (II) with a nucleator of formula (III), in which the nucleating agent of formula (J) comprises (a) two nicotinamide moieties, which may be the same or different, which are linked by a linking group, and (b) a hydrazide moiety linked to only one of those nicotinamide moieties; the nucleating agent of formula (II) comprises a dimeric molecule comprising two monomers linked by a linking group, each monomer of which (a) may be the same or different and (b) comprises a hydrazide moiety and a nicotinamide moiety; and the nucleating agent of formula (III) comprises an aryl sulfonamido aryl hydrazide.

In another aspect of the invention there is provided an ultrahigh contrast photographic material, as hereinbefore defined, which also contains in the emulsion layer or a hydrophilic colloid layer, a booster compound, as hereinafter defined.

In yet another aspect of the invention there is provided a process of forming a photographic image having ultrahigh contrast which comprises imagewise exposing a photographic material comprising a support bearing a silver halide emulsion layer and processing it with an alkaline developer solution, characterised in that it is developed in the presence of a combination of two or more hydrazide nucleating agents, comprising a nucleating agent of formula (I) and/or (II) with a nucleating agent of formula (III), optionally in the presence of a booster compound, as hereinafter defined.

ADVANTAGEOUS EFFECT OF THE INVENTION

The combination of nucleating agents for use in the invention show less sensitivity to variation in the development conditions than do the individual nucleating types.

This leads to significant improvements in processing robustness with reduced density variation across the length and width of processed sheets, making the processing more uniform and reducing the variation in the day-to-day running of the film and processor. There is less change in image quality with processing and tolerance to a wider range of developer solutions.

DETAILED DESCRIPTION OF THE INVENTION

The nucleators of formula (I) for use in photographic materials of the invention preferably have one of the following general formulae:

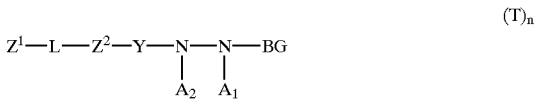

(T)n or

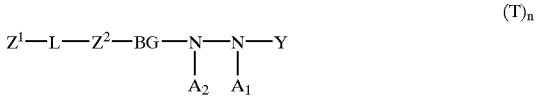

(T)n wherein BG is a blocking group;

one of $A_1$ and $A_2$ is a hydrogen atom and the other is a hydrogen atom, an acyl group or an alkyl- or arylsulfonyl group, any of which groups may be substituted, $Z^1$ and $Z^2$ are the same or different and each is a nicotinamide residue, at least one of which is positively charged;

Y is a substituted aryl or heterocyclic ring;

L is a linking group;

T is an anionic counterion and n is 1 or 2.

The nucleators of formula (II) preferably have one of the following general formulae:

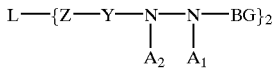

2T or

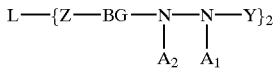

2T wherein each monomer linked by linking group L is the same or different;

Z is a positively charged nicotinamide residue; and

Y, $A_1$, $A_2$, BG, L and T are as defined for a compound of formula (I).

The nucleators of formula (III) preferably have the general formula:

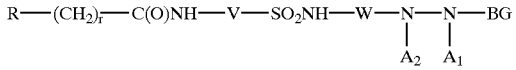

wherein V and W are independently a substituted or unsubstituted arylene group;

r is 1 to 6;

R is selected from the class consisting of S—R', wherein R' is an unsubstituted or substituted monovalent group comprising at least three ethyleneoxy units, and a positively charged pyridinium residue substituted with from 1 to 3 unsubstituted or substituted alkyl groups, with its associated cation;

and $A_1$, $A_2$ and BG are as defined for a compound of formula (I).

In a preferred embodiment in each of the formulae (I), (II) and (III) d $A_2$ is a hydrogen atom.

More preferably the nucleating agent of formula (I) has one of the following formulae A, B or C, formula A being the most preferred:

(A)

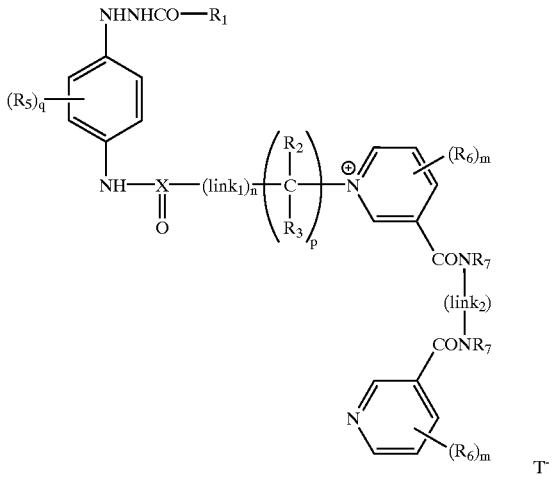

T⁻

-continued
(B)
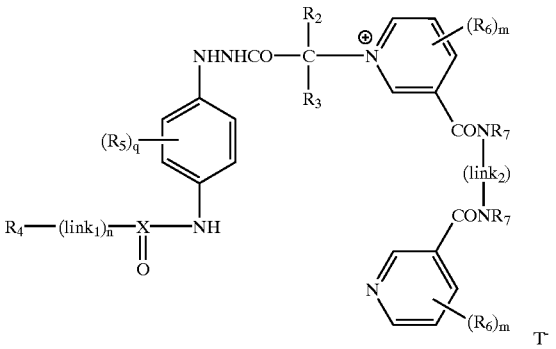
(C)
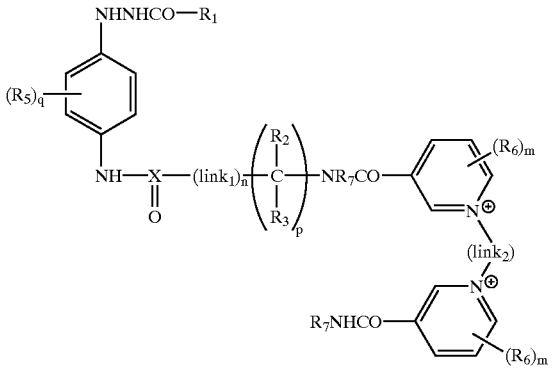
More preferably the nucleating agent of formula (II) has one of the following formulae D, E or F, formula D being the most preferred:
(D)
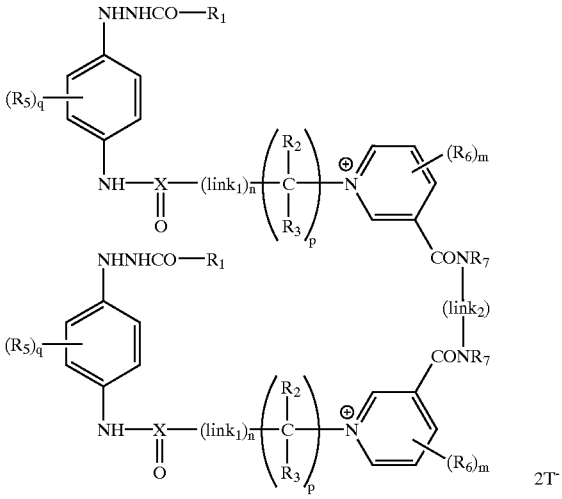
-continued
(E)
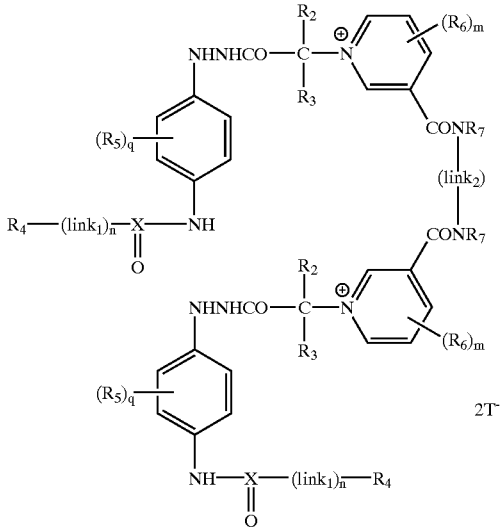
(F)
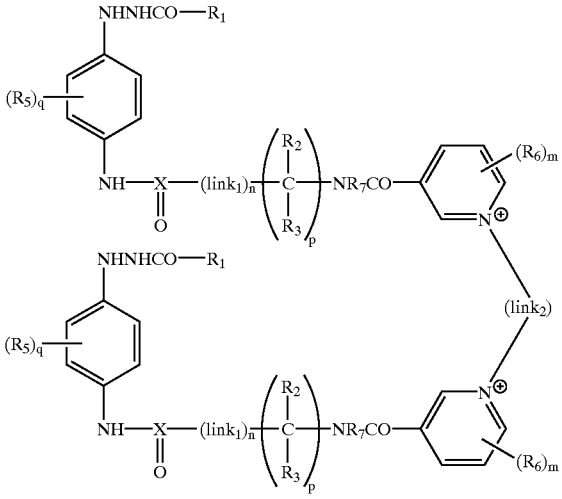
More preferably the nucleating agent of formula (III) has one of the following formulae (G) or (H):
(G)
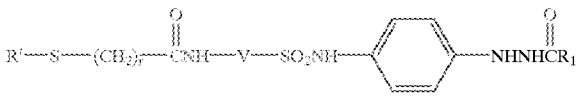
or
(H)
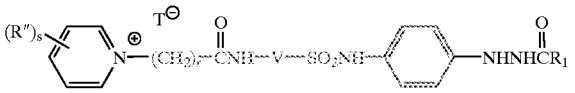

In these embodiments (A) to (H), each $R_1CO$ comprises a blocking group and in particular each $R_1$ is independently selected from a hydrogen atom and an unsubstituted or substituted alkyl, aryl, alkoxy, aryloxy, alkoxy- or aryloxy-carbonyl and alkyl- or aryl-aminocarbonyl group; or each $R_1$ independently is or contains an unsubstituted or substituted heterocyclic group, having a 5- or 6-membered ring containing at least one nitrogen, oxygen or sulfur atom, wherein the ring may be linked either directly to the carbonyl group or via an alkyl, alkoxy, carbonyl, amino- or alkylamino-carbonyl group and wherein the ring may be fused to a benzene ring;

each $R_2$ and each $R_3$ is independently selected from hydrogen and an unsubstituted or substituted alkyl or aryl group and each p is independently 0 or 1;

each $R_4$ and each $R_5$ and each $R_6$ is independently selected from hydrogen, halogen, hydroxy, cyano and an unsubstituted or substituted alkyl, aryl, heterocyclyl, alkoxy, acyloxy, aryloxy, carbonamido, sulfonamido, ureido, thioureido, semicarbazido, thiosemicarbazido, urethane, quaternary ammonium, alkyl- or aryl-thio, alkyl- or aryl-sulfonyl, alkyl- or aryl-sulfinyl, carboxyl, alkoxy- or aryloxy-carbonyl, carbamoyl, sulfamoyl, phosphonamido, diacylamino, imido or acylurea group, a group containing a selenium or a tellurium atom, and a group having a tertiary sulfonium structure;

each m is independently an integer from 0 to 4;

each q is independently an integer from 0 to 4;

each $R_7$ is independently selected from hydrogen and an unsubstituted or substituted alkyl or aryl group;

each X is independently selected from C, S═O and C—NH;

each ($link_1$) is a linking group independently selected from an unsubstituted or substituted alkylene, polyalkylene, aryl, arylaminocarbonyl or heterocyclyl group and each n is independently 0 or 1;

each ($link_2$) is a linking group independently selected from an unsubstituted or substituted polyalkylene, polyalkylene oxide, polyalkylene containing one or more heteroatoms selected from nitrogen, oxygen and sulfur, separated from each other by alkylene groups, or an unsubstituted or substituted polyalkylene in which the alkylene groups are separated by an unsubstituted or substituted aryl or heterocyclic ring;

V is an unsubstituted or substituted phenylene or naphthalene group;

R' is an unsubstituted or substituted monovalent group comprising at least three ethyleneoxy units;

R" is an unsubstituted or substituted alkyl group;

r is 1 to 6;

s is 1 to 3 and $T^-$ is an anionic counterion.

The term 'blocking group' refers to a group suitable for protecting the (hydrazine) group but which is readily removable when necessary.

It is preferred that $R_1$ is a hydrogen atom or a group selected from unsubstituted or substituted alkyl, for example methyl, trifluoromethyl, 3-methylsulfonamidopropyl, methyl- or phenyl-sulfonylmethyl, carboxy-tetrafluoroethyl; unsubstituted or substituted aryl, for example phenyl, 3,5-di-chlorophenyl, o-methane-sulfonamidophenyl, 4-methanesulfonylphenyl, 2(2'-hydroxyethyl)phenyl, 2-hydroxy-4-methylphenyl, 2-hydroxymethylphenyl, o-hydroxybenzyl, hydroxyalkylbenzyl; a carbonyl-containing group, for example an alkylamino-, alkoxy-, aryloxy- or hydroxyalkylamino-carbonyl; or contains an imidazolyl, pyrazolyl, triazolyl, tetrazolyl, pyridyl, pyridinium, piperidinyl, morpholino, quinolinium or a quinolinyl group or $R_1$ may include a group which splits off a photographically useful fragment, such as a phenylmercaptotetrazole or a 5-or 6-nitroindazole group. Examples of some of these are disclosed in U.S. Pat. No. 5,328,801.

More preferably in compounds of formulae (I) and (II) $R_1$ contains a morpholino group and especially has the formula —$CONH(CH_2)_n$-morpholino, wherein n is 0–4 and is conveniently 3.

$R_2$ and $R_3$ are preferably hydrogen atoms or alkyl groups with p being preferably 1 and $R_4$, $R_5$ and $R_6$ being preferably hydrogen, alkyl, alkoxy, alkylthio, trifluoromethyl or methylsulfonamido groups, with q being preferably 0 or 1 and m being preferably 0. $R_7$ is preferably hydrogen or an alkyl group, optionally substituted with, for example, a dialkylamino group.

When X is S═O or C—NH it is preferred that n is 1 and that (link,) comprises an arylamino group or an arylaminocarbonyl group, preferably a phenylaminocarbonyl group, which may be substituted in the ring, for example, with one or more alkyl, carboxyl groups or halogen atoms. When X is C it is preferred that n is 0 such that no ($link_1$) group is present.

The ($link_2$) group preferably comprises a polyalkylene group comprising alkylene groups, preferably methylene groups, typically four or six, which may be separated by one or more O or S atoms. For example ($link_2$) may be $(CH_2)_4$, $(CH_2)_6$, $(CH_2)_2S(CH_2)_2$ or $(CH_2)_2O(CH_2)_2O(CH_2)_2$. Alternatively ($link_2$) may be a polyalkylene oxide chain extending from an even number of methylene groups such as $(CH_2CH_2O)_{14}CH_2CH_2$ or may comprise, for example, a $CHU_2C_6H_4CH_2$ group.

In formula (III), both V and W may be substituted with one or more substituents such as, or example, an alkyl, halo, alkoxy, haloalkyl or alkoxyalkyl group. V and W are preferably each a phenylene group.

In formula (G) there are least three repeating ethyleneoxy units in R', more preferably from four to fourteen units and even up to fifty repeating ethyleneoxy units. In formula (H) the sum of the number of carbon atoms represented by R" is preferably at least 4, more preferably at least 8, each R" group preferably having from 1 to 12 carbon atoms.

The anionic counterion may be selected from any well known in the art and may typically be selected from $Cl^-$, $Br^-$, $I^-$, $CF_3COO^-$, $CH_3SO_3^-$ and $TsO^-$.

As used herein and throughout the specification the term alkyl refers to an unsaturated or saturated straight or branched chain alkyl group (including alkenyl and aralkyl) having 1–20 atoms and includes cycloalkyl having 3–8 carbon atoms. The term aryl specifically includes fused aryl and the term heterocyclic specifically includes fused heterocyclic within its scope. The term polyalkylene is defined as the group $(CH_2)_n$ wherein n is an integer from 2 to 50.

Unless otherwise specifically stated, substituent groups usable on molecules herein include any groups, whether substituted or unsubstituted, which do not destroy properties necessary for photographic utility.

When the term "group" is applied to the identification of a substituent containing a substitutable hydrogen, it is intended to encompass not only the substituent's unsubstituted form, but also its form further substituted with any group or groups as herein mentioned.

Suitably, the group may be halogen or may be bonded to the remainder of the molecule by an atom of carbon, silicon, oxygen, nitrogen, phosphorus, or sulfur. The substituent may be, for example, halogen, such as chlorine, bromine or fluorine; nitro hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethyl-phenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)-acetamido, alpha-(2,4-di-t-pentylphenoxy)butyramido, alpha-(3-pentadecylphenoxy)-hexanamido, alpha-(4-hydroxy-3-t-butylphenoxytetradecanamido, 2-oxo-pyirolidin-1-yl, 2-oxo-5-tetradecylpyrrolidin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino,p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-di-octyl-N'-ethylureido, N-phenylureido, N,N-diphenylureido, N-phenyl-N-p-toluyl-ureido, N-(m-hexadecylphenyl) ureido, N,N-(2,5-di-t-pentylphenyl)-N'-ethylureido, and t-butylcarbonamido; sulfonamido, such as methylsulfonamido, benzene-sulfonamido, p-toluylsulfonamido, p-dodecylbenzenesulfonamido, N-methyltetradecylsulfonamido, N,N-di-propylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(do-decyloxy)propyl]-sulfamoyl, N-[4-(2,4-di-t-pentylphenoxybutyl]sulfamoyl, N-methyl-N-tetradecyl-sulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)-butyl] carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxy-phenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxy-carbonyl; sulfonyl, such as methoxysulfonyl, octyloxysulfonyl, tetradecyloxy-sulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecyl-sulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methyl-sulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamido-benzoyloxy, N-phenylcarbamoyloxy, N-ethylcarbamoyloxy, and cyclohexylcarbonyloxy; amine, such as phenylanilino, 2-chloroanilino, diethylamine, dodecylamine; imido, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups and groups which adsorb to silver halide. Generally, the above groups and substituents thereof may include those having up to 48 carbon atoms, typically 1 to 36 carbon atoms and usually less than 24 carbon atoms, but greater numbers are possible depending on the particular substituents selected.

In some embodiments, the nucleators of the invention may be selected from the following:

Compounds of formula (I)

(M1)

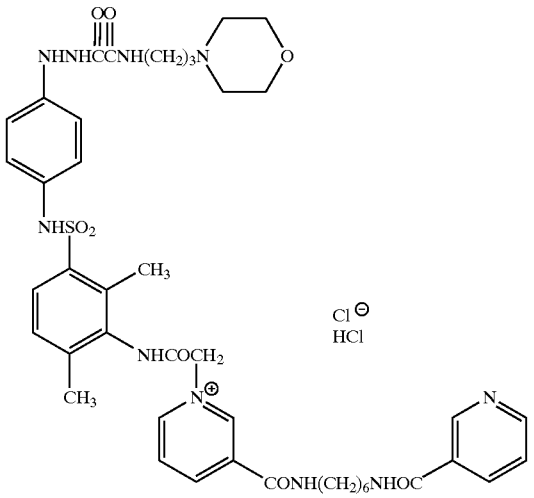

(M2)

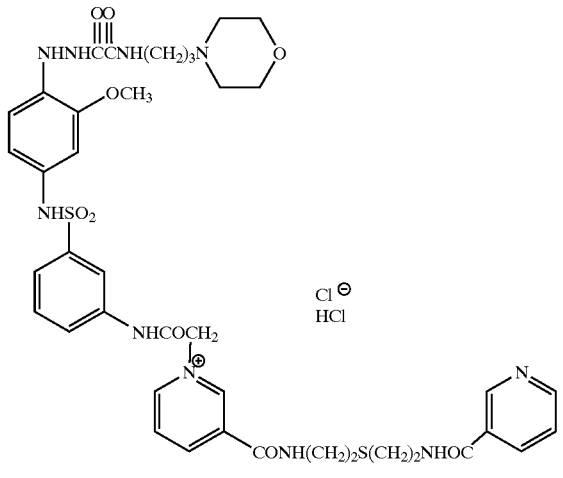

-continued
(M3)
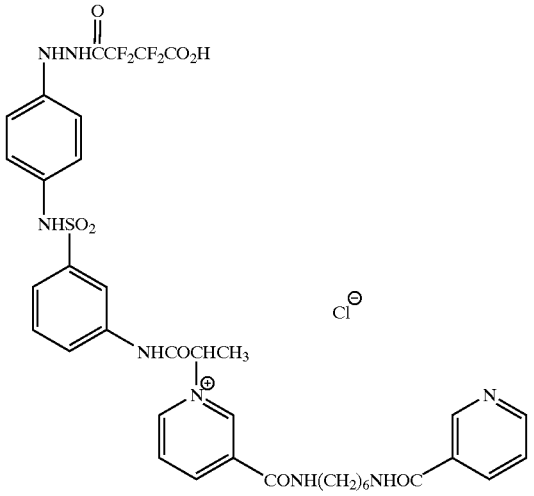
(M4)
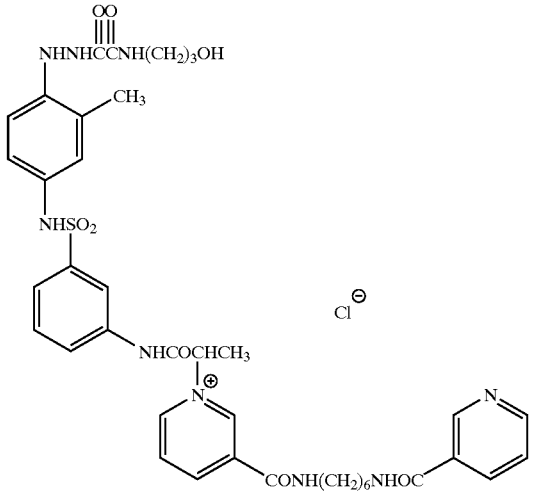
(M5)
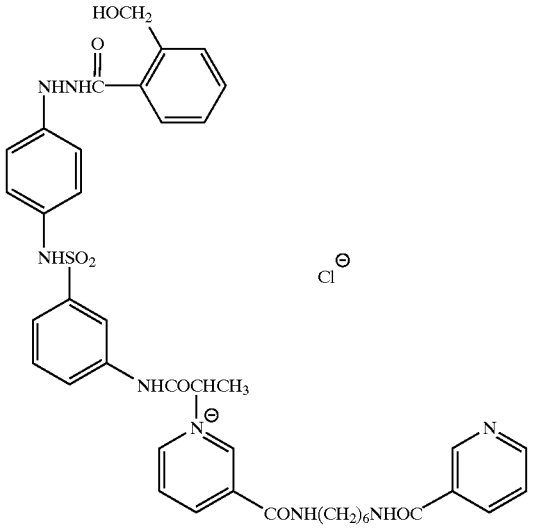
(M6)
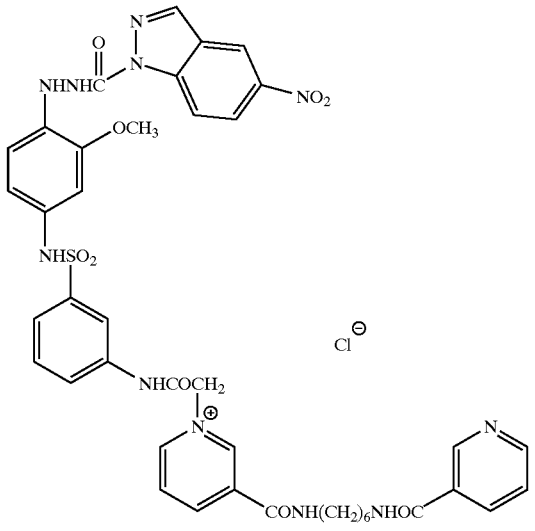
(7)
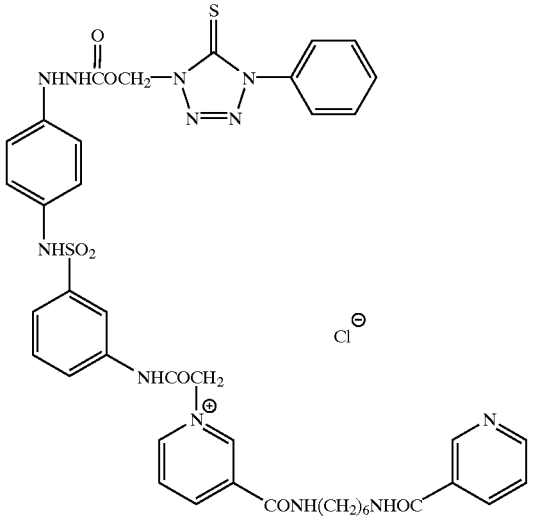

-continued
(8)
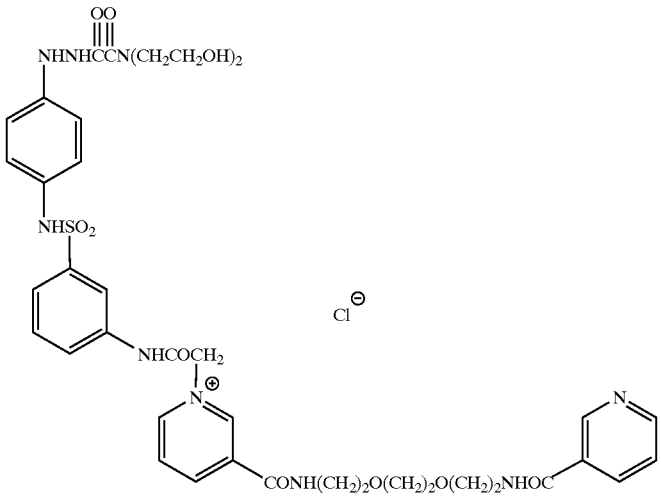
(9)
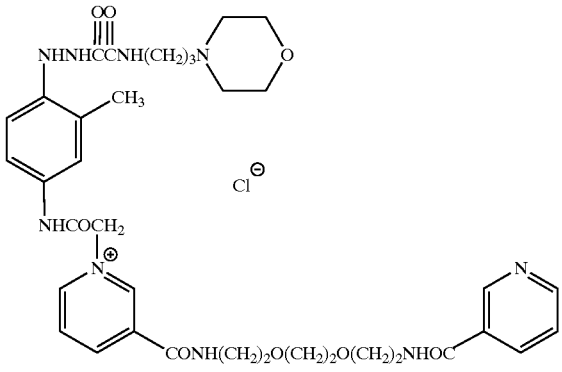
(M10)
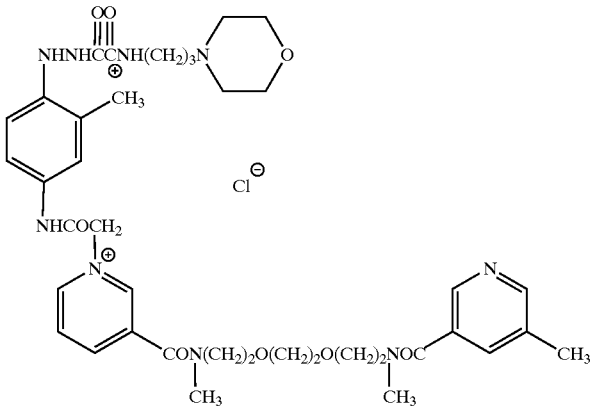
(M11)
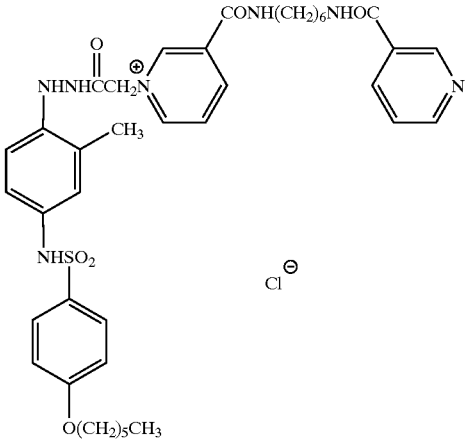

-continued
(M12)
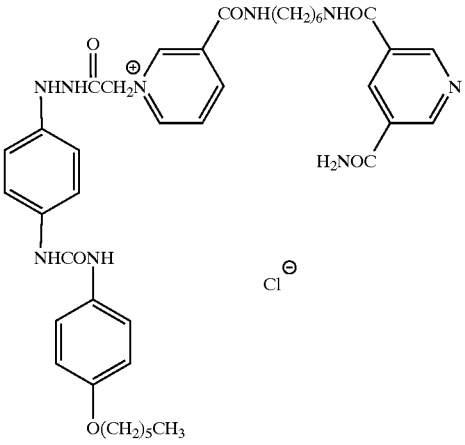
(M13)
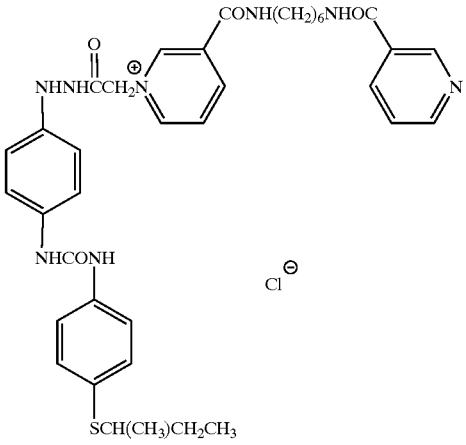
(M14)
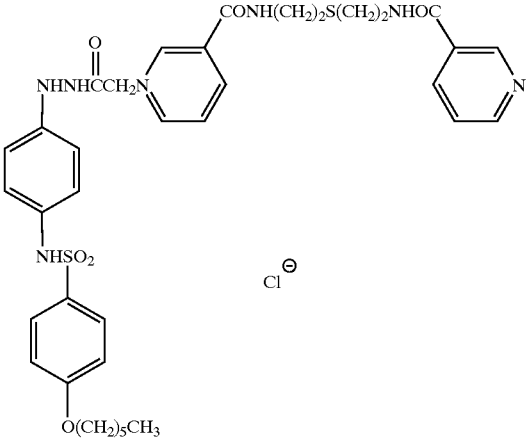
(M15)
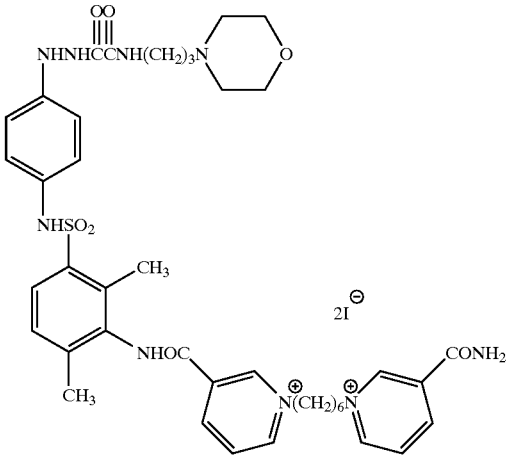
(M16)
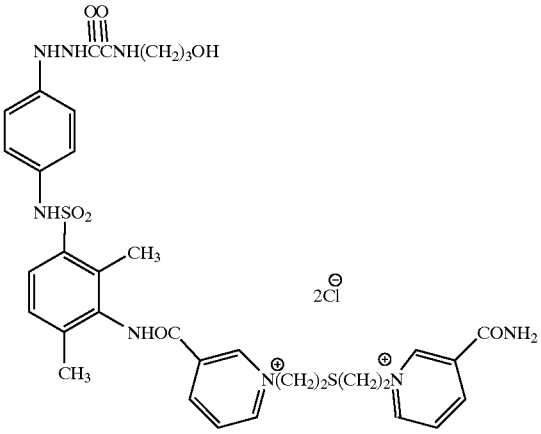
(M17)
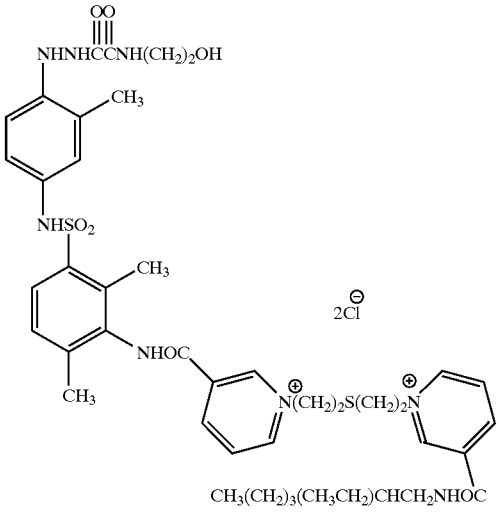

-continued
(M18)
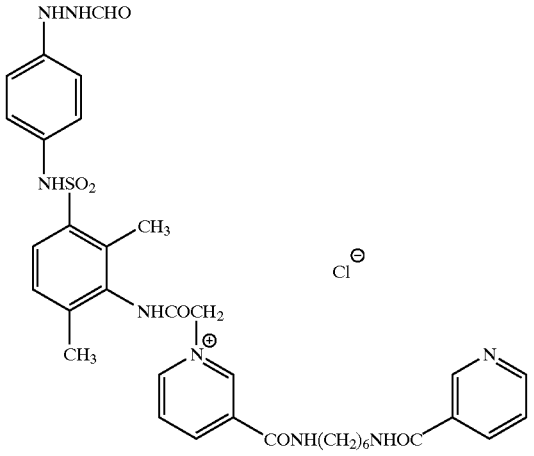
(M19)
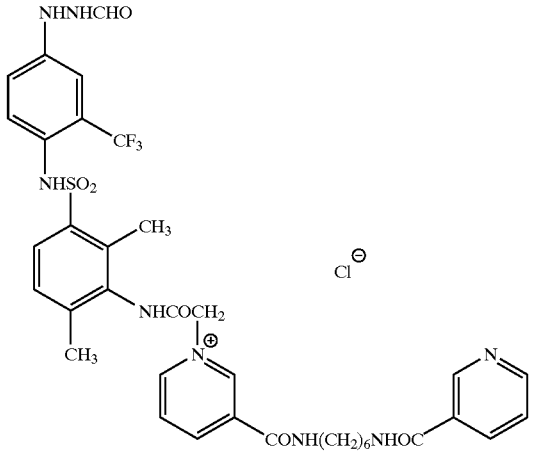
(M20)
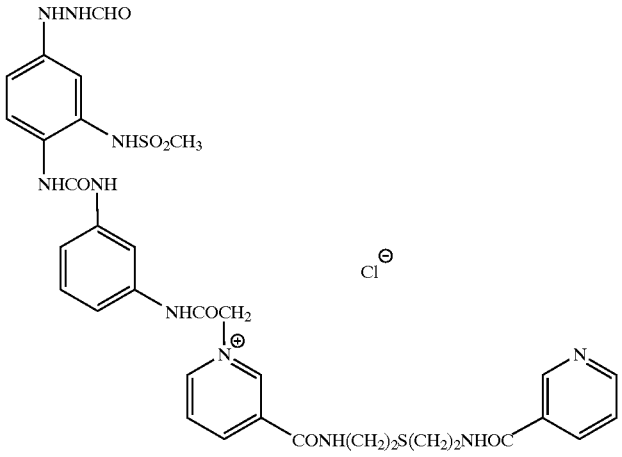
(M21)
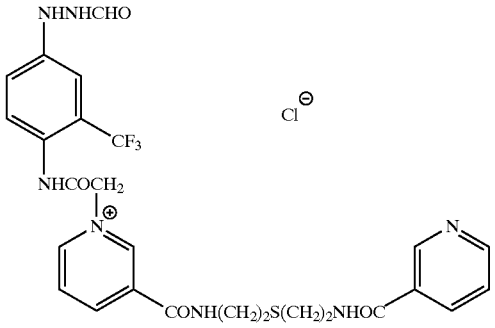
(M22)
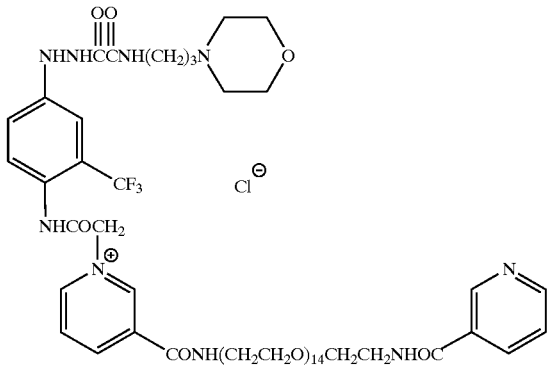

Compounds of formula (II)
(N1)
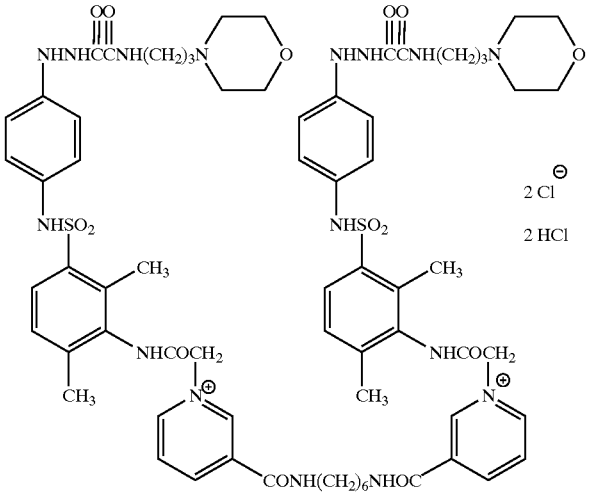
(N2)
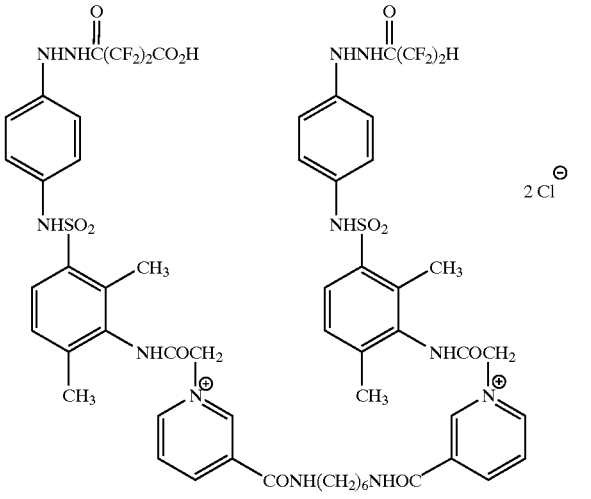
(N3)
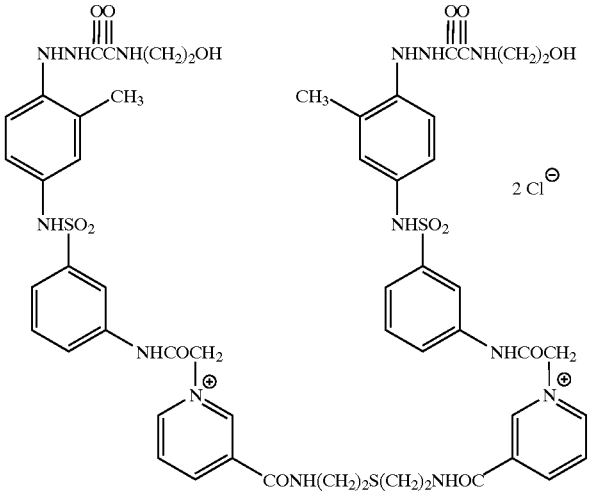

-continued
(N4)
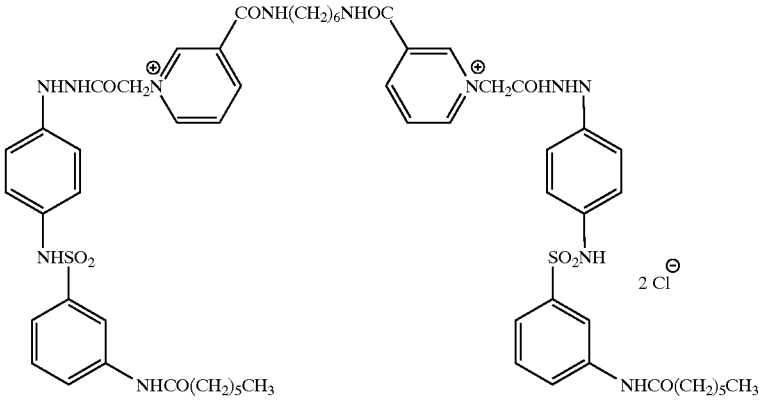
(N5)
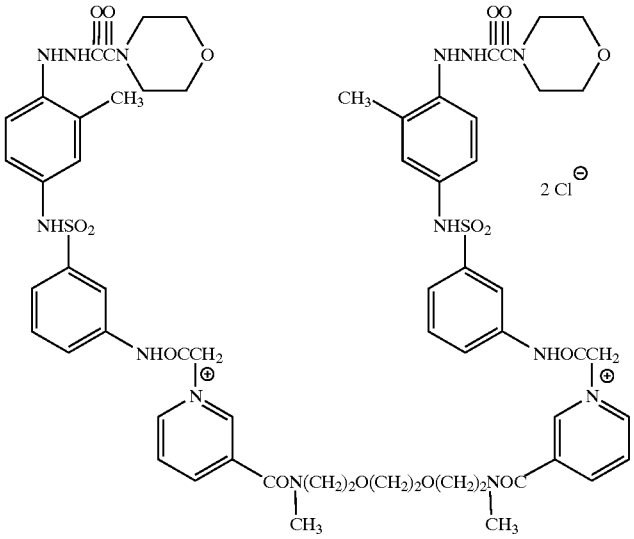
(N6)
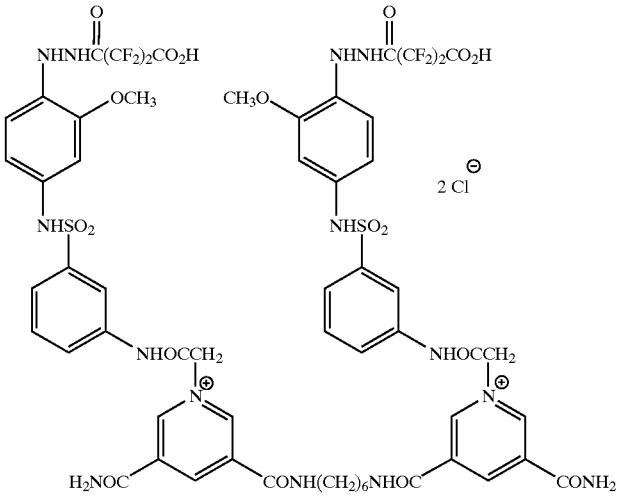

-continued
(N7)
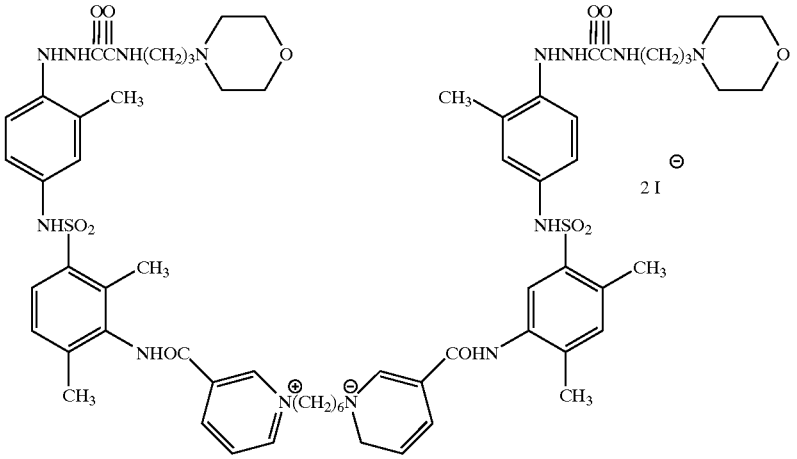
(N8)
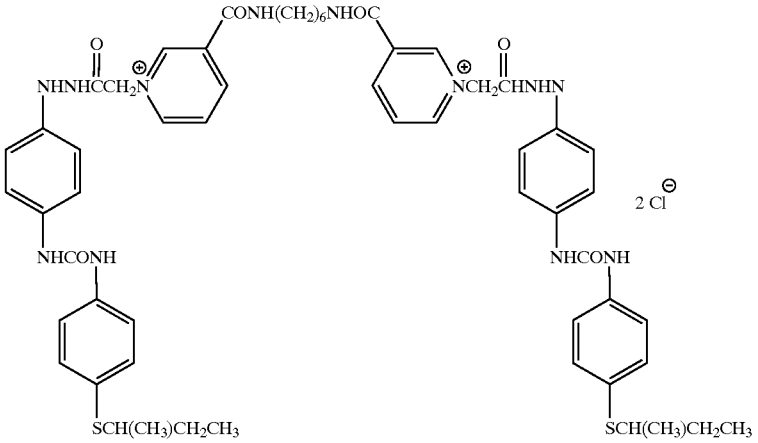
Compounds of formula (III)
I-1
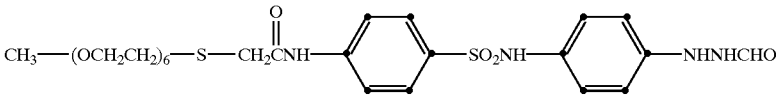
I-2
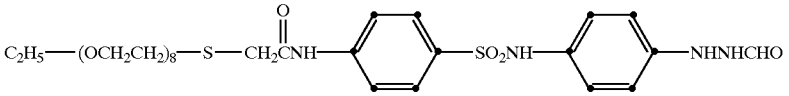
I-3
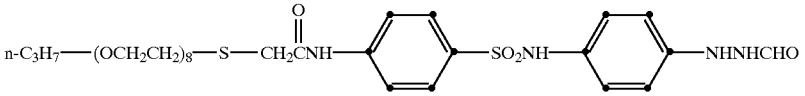
I-4
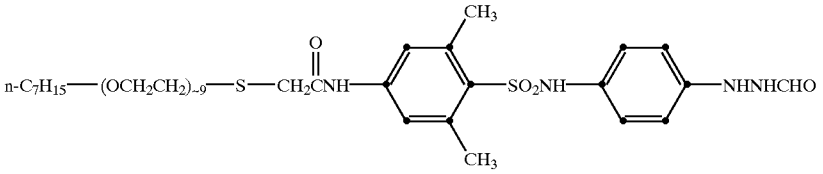

-continued
I-5
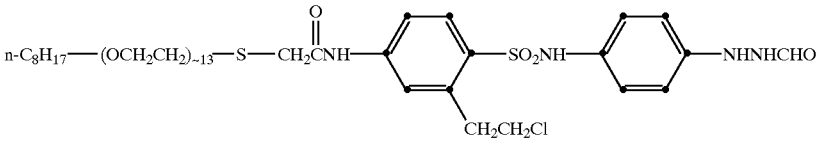
I-6
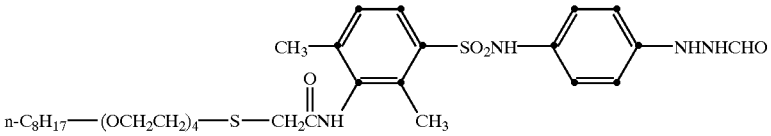
I-7
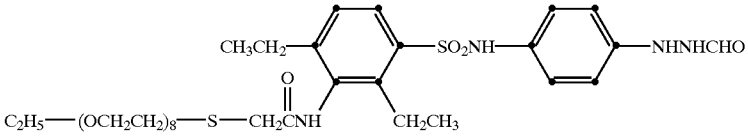
I-8
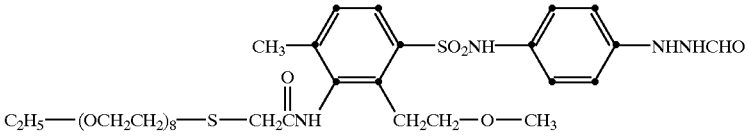
I-9
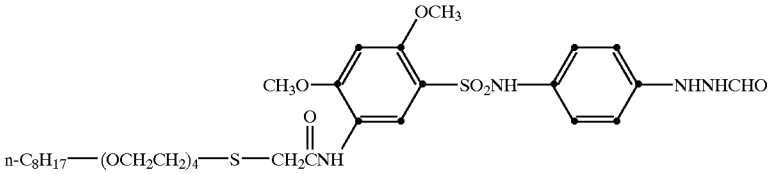
I-10
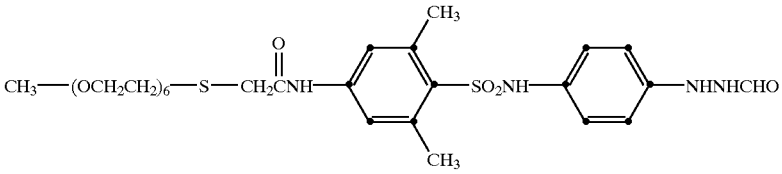
I-11
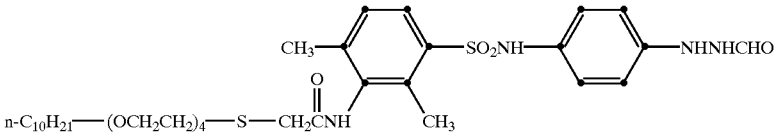
I-12
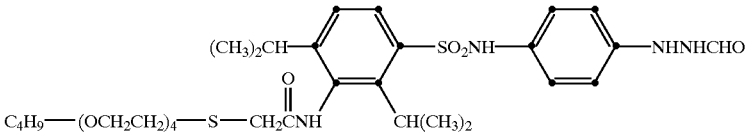
I-13
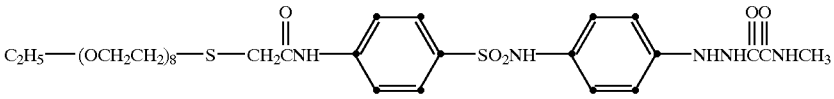
I-14
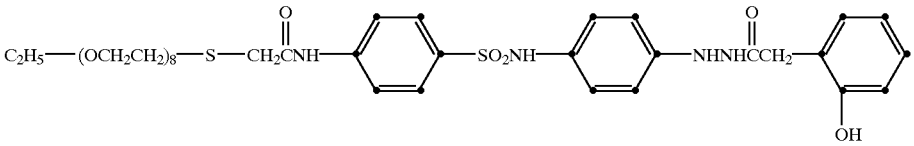

-continued
I-15
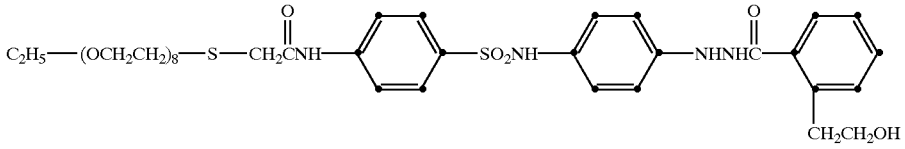
I-16
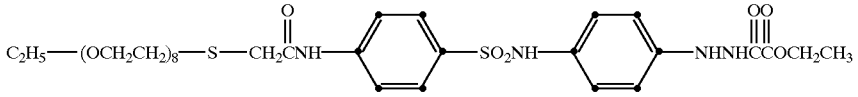
Compounds of formula (III)
J-1
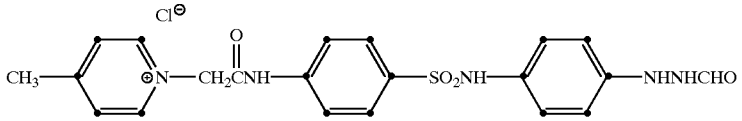
J-2
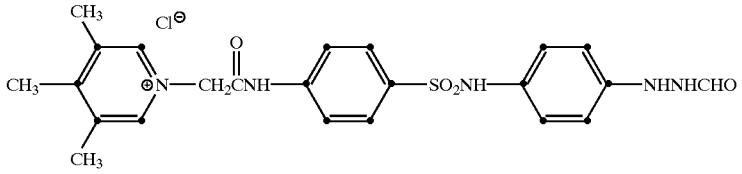
J-3
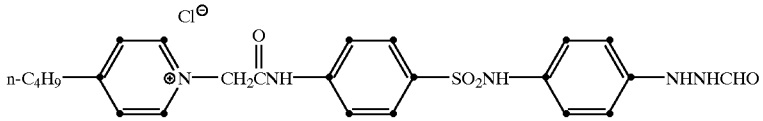
J-4
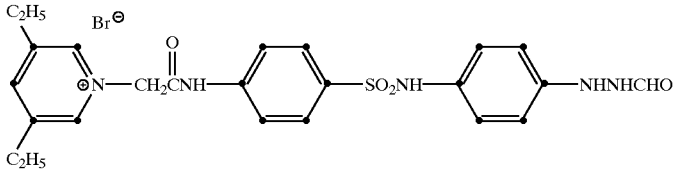
J-5
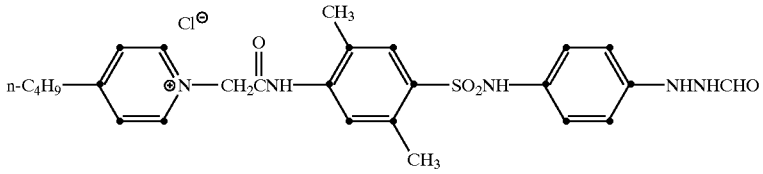
J-6
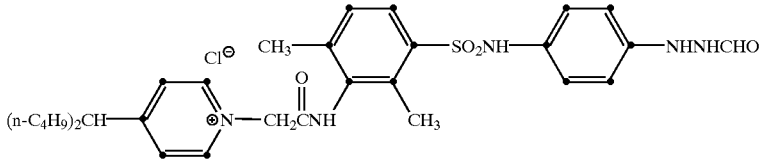
J-7
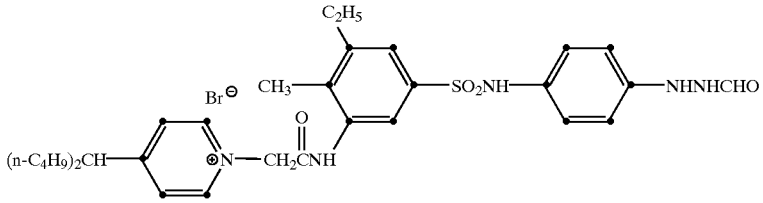

-continued
J-8
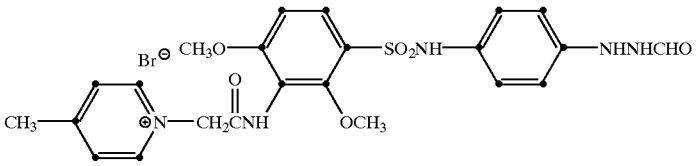
J-9
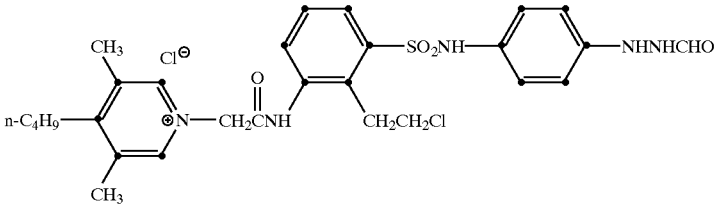
J-10
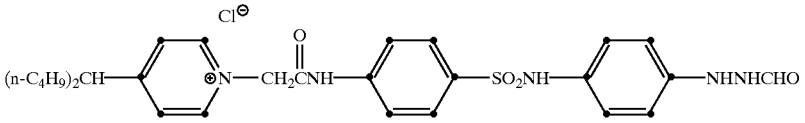
J-11
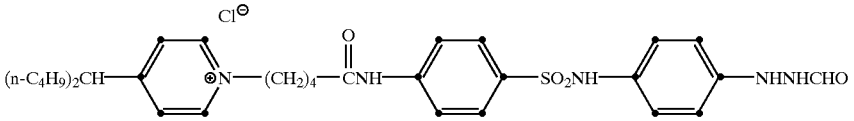
J-12
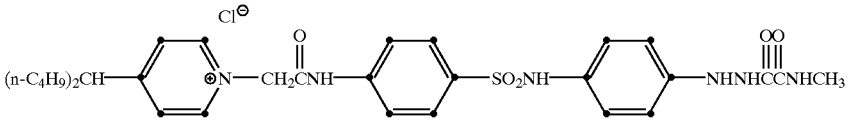
J-13
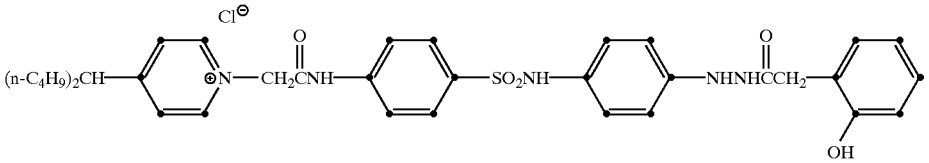
J-14
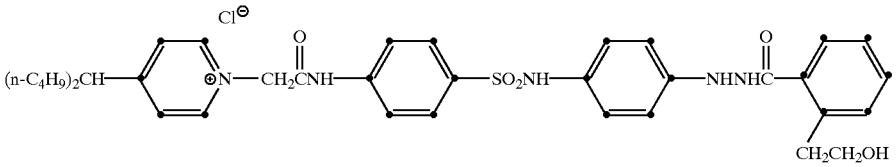
J-15
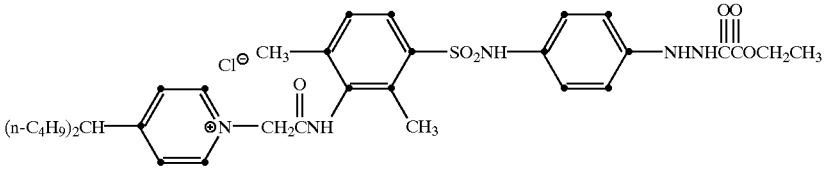

The photographic material of the invention may also contain a booster compound to enhance the ultrahigh contrast and to promote activity. Alternatively the booster compound can be present in the developer solution.

One class of such boosters are amines which (1) comprise at least one secondary or tertiary amino group, and (2) have an n-octanol/water partition coefficient (log P) of at least one, preferably at least three, and most preferably at least four, log P being defined by the formula:

$$\log P = \log\frac{[X_{octanol}]}{[X_{water}]}$$

wherein X is the concentration of the amino compound.

Preferably such an amine contains within its structure a group comprising at least three repeating ethyleneoxy units as described in U.S. Pat. No. 4,975,354. These units are preferably directly attached to the nitrogen atom of a tertiary amino group.

Included within the scope of the amino compounds that may be utilised in this invention are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amine boosters are compounds having at least 20 carbon atoms.

Preferred amino compounds for inclusion in photographic materials of the invention are bis-tertiary amines which have a partition coefficient of at least three and a structure represented by the formula:

$$R^1R^2N(CH_2CH_2O)_nCH_2CH_2NR^3R^4$$

wherein n is an integer from 3 to 50, and more preferably 10 to 50;

$R^1$, $R^2$, $R^3$ and $R^4$ are, independently, alkyl groups of 1 to 8 carbon atoms, or $R^1$ and $R^2$ taken together represent the atoms necessary to complete a heterocyclic ring, and/or $R^3$ and $R^4$ taken together represent the atoms necessary to complete a heterocyclic ring.

A particularly preferred booster for use in photographic materials of the invention or in the developer therefor is the booster B1 wherein in the above formula $R^1$, $R^2$, $R^3$ and $R^4$ are each n-propyl groups and n is 14, i.e. the structure:

(B1)

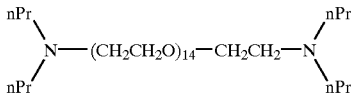

Another preferred group of amino compounds is that of bis-secondary amines which have a partition coefficient of at least three and a structure represented by the formula:

$$RHN(CH_2CH_2O)_nCH_2CH_2NHR$$

wherein n is an integer from 3 to 50, and more preferably 10 to 50, and each R is, independently, a linear or branched, substituted or unsubstituted, alkyl group of at least 4 carbon atoms.

Particular amines suitable as booster compounds are listed in EP-A-0 364 166.

Other types of boosters are described in U.S. Pat. No. 5,744,279 as having one of the formulae:

(a) $Y((X)_n—A—B)_M$ wherein

Y is a group which adsorbs to silver halide,

X is a divalent linking group composed of hydrogen, carbon, nitrogen and sulfur atoms, A is a divalent linking group, B is an amino group that may be substituted or an ammonium group of a nitrogen-containing heterocyclic group, m is 1,2 or 3 and n is 0 or 1, (b) $R^1R^2N—R^3—(X)_n—SM_x$ wherein $R^1$ and $R^2$ are each hydrogen or an aliphatic group, or $R^1$ and $R^2$ may together form a ring, $R^3$ is a divalent aliphatic group, X is a divalent heterocyclic ring having at least one nitrogen, oxygen or sulfur atom as heteroatom, n is 0 or 1, M is hydrogen or an alkali metal atom, alkaline earth metal atom, a quaternary ammonium, quaternary phosphonium atom or an amidino group, and x is 1 when M is a divalent atom;

said compound optionally being in the form of an addition salt;

(c) a phosphonium structure as disclosed in col. 8 of U.S. Pat. No. 5,744,279 and as exemplified by the following formula:

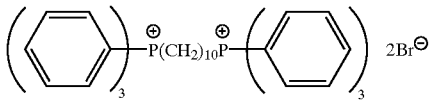

or (d) a pyridinium structure as disclosed in col. 21 of the aforementioned US patent as exemplified by the following formula:

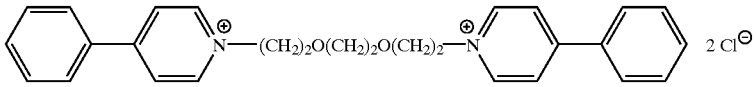

The nucleators and optionally the booster compound can be incorporated in the photographic element, for example in a silver halide emulsion layer. Alternatively they can be present in a hydrophilic colloid layer of the photographic element, preferably a hydrophilic layer which is coated to be adjacent to the emulsion layer in which the effects of the nucleator are desired. They can however be present in the photographic element distributed between or among emulsion and hydrophilic colloid layers, such as undercoating layers, interlayers and overcoating layers.

The total amount of nucleating agent of formula (J) and/or (II) is from about 0.3 $\mu$mol/m$^2$ to 70 $\mu$mol/m$^2$, preferably 1 $\mu$mol/m$^2$ to 10 $\mu$mol/m$^2$, more preferably 2 $\mu$mol/m$^2$ to 7 $\mu$mol/m$^2$. The amount of nucleating agent of formula (III) is from about 0.14 $\mu$mol/m$^2$ to 70 $\mu$mol/m$^2$, preferably 0.7 $\mu$mol/m$^2$ to 14 $\mu$mol/m$^2$, more preferably 1.4 $\mu$mol/m$^2$ to 7 $\mu$mol/m$^2$. Preferably the ratio of the amount of a nucleating agent of formula (I) and/or (II): a nucleating agent of formula (III) is greater than 1.0, preferably greater than 1.5. Corresponding amounts for the booster are from 0 mol/m$^2$ to about 1 mmol/m$^2$, preferably 10 $\mu$mol/m$^2$ to 100 $\mu$mol/m$^2$, most preferably 30 $\mu$mol/m$^2$ to 100 $\mu$mol/m$^2$.

When a nucleating agent of formula (I) is in combination with a nucleating agent of formula (II), any relative proportions of the components may achieve the advantages of the invention. However preferably the amount of nucleating agent of formula (I): nucleating agent of formula (II) is in the range from about 10:90 to about 90:10, preferably from about 20:80 to about 80:20. Conveniently however for simplicity of synthesis the nucleating agent of formula (II) is produced in excess and generally the relative amounts of the components are then in the range about 10:90 to about 30:70.

The emulsions employed in photographic materials of the invention and the addenda added thereto, the binders, supports etc. may be as described in Research Disclosure Item 36544, September 1994, published by Kenneth Mason Publications, Emsworth, Hants, PO10 7DQ, United Kingdom, which will be identified hereinafter by the term "Research Disclosure."

The hydrophilic colloid may be gelatin or a gelatin derivative, polyvinylpyrrolidone or casein and may contain a polymer. Suitable hydrophilic colloids and vinyl polymers and copolymers are described in Section IX of the Research Disclosure. Gelatin is the preferred hydrophilic colloid.

The photographic materials may also contain an overcoat hydrophilic colloid layer which may also contain a vinyl polymer or copolymer located as the last layer of the coating (furthest from the support). It contains one or more surfactants to aid coatability and may also contain some form of matting agent. The vinyl polymer is preferably an acrylic polymer and preferably contains units derived from one or more alkyl or substituted alkyl acrylates or methacrylates, alkyl or substituted alkyl acrylamides, or acrylates or acrylamides containing a sulfonic acid group.

The photographic materials of the invention preferably contain an antihalation layer that may be on either side of the support, preferably on the opposite side of the support from the emulsion layer. In a preferred embodiment an antihalation dye is contained in the hydrophilic colloid underlayer. The dye may also be dissolved in or dispersed in the underlayer. Suitable dyes are listed in the Research Disclosure disclosed above.

The emulsions are preferably chemically sensitised, for example with both sulfur and gold. The latent-image forming grains can be bromoiodide, chlorobromoiodide, bromide, chlorobromide, chloroiodide or chloride, preferably chlorobromide. They should preferably be spectrally sensitised. More than one type of spectrally sensitised silver halide grain may be present and hence grains sensitised to different spectral regions may be present in the emulsion layer.

The coating may be made by blending two or more emulsion melts containing grains of the required spectral sensitivity, allowing the production of multi-wavelength sensitive products and giving rise to manufacturing cost advantages through both material and inventory reduction. Combining the different emulsion grains within one layer can give improvements in process sensitivity over multilayer graphics nucleated systems, as described in EP-A-0 682 288.

The silver halide grains may be doped with rhodium, ruthenium, iridium or other Group VIII metals either alone or in combination, preferably at levels in the range $10^{-9}$ to $10^{-3}$, preferably $10^{-6}$ to $10^{-3}$ mole metal per mole of silver. The grains may be mono- or poly-disperse. The preferred Group VIII metals are rhodium and/or iridium and ammonium pentachlororhodate may conveniently be used.

The present photographic materials are particularly suitable for exposure by red or infra-red laser diodes, light emitting diodes or gas lasers, e.g. a helium/neon or argon laser.

The light-sensitive silver halide contained in the photographic elements can be processed following exposure to form a visible image by associating the silver halide with an aqueous alkaline medium in the presence of a developing agent contained in the medium or the element. The photographic elements of this invention can be processed in conventional developers as opposed to specialised developers sometimes employed in conjunction with lithographic photographic elements to obtain very high contrast images. When the photographic elements contain incorporated developing agents the elements can be processed in the presence of an activator, which can be identical to the developer in composition, but otherwise lacking a developing agent.

Very high contrast images can be obtained at pH values below 11, preferably in the range of from 10.0 to 10.8, preferably in the range of 10.3 to 10.5 and especially at pH 10.4.

The developers are typically aqueous solutions, although organic solvents, such as diethylene glycol, can also be included to facilitate the solution of organic components. The developers contain one or a combination of conventional developing agents, such as, for example, a polyhydroxybenzene, such as dihydroxybenzene; aminophenol, paraphenylenediamine; ascorbic acid, eiythorbic acid and derivatives thereof, pyrazolidone, pyrazolone, pyrimidine, dithionite and hydroxylamine.

It is preferred to employ hydroquinone and 3-pyrazolidone developing agents in combination or an ascorbic acid-based system. An auxiliary developing agent exhibiting superadditive properties may also be used. The pH of the developers can be adjusted with alkali metal hydroxides and carbonates, borax and other basic salts. It is, as previously mentioned, a particular advantage of the present invention that the use of nucleators as described herein reduces the sensitivity of the photographic material to changes in this developer pH.

To reduce gelatin swelling during development, compounds such as sodium sulfate can be incorporated into the developer. Chelating and sequestering agents, such as ethylenediaminetetraacetic acid or its sodium salt, can be present. Generally any conventional developer can be used in the practice of this invention. Specific illustrative photographic developers are disclosed in the Handbook of Chemistry and Physics, 36$^{th}$ Edition, under the title "Photographic Formulae" at page 30001 et seq. and in "Processing Chemicals and Formulas" 6$^{th}$ Edition, published by Eastman Kodak Company (1963).

The invention will now be described with reference to the following examples that are in no way to be considered as limiting the scope thereof.

EXAMPLE 1

The following preparation synthetic scheme for the preparation of nucleator (M1) of formula (I) is as follows, with full experimental details being provided in EP patent application No. 01201989.9:

2,6-Dimethyl-3-(4-[3-morpholinopropylcarbamoylcarbonylhydrazino]-phenylsulfamoyl)phenylcarbamoylhethyl 3-(6-pyrid-3-ylamido-hexamethylenecarbamoyl)pyridinium chloride hydrochloride. (M1).

Step 1: Preparation of ethyl 4-nitrophenylhydrazinooxalate

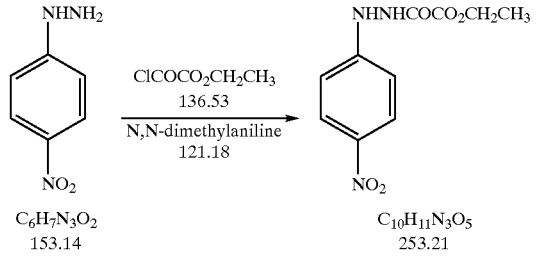

Step 2: Preparation of N-(3-morpholinopropylcarbamoylcarbonyl)-4-nitro-phenylhydrazine

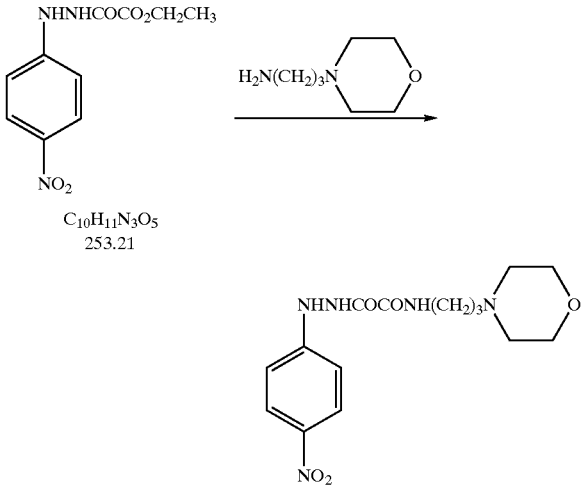

Step 3: Preparation of 4-Amino-N-(3-morpholinopropylcarbamoylcarbonyl)-phenylhydrazine

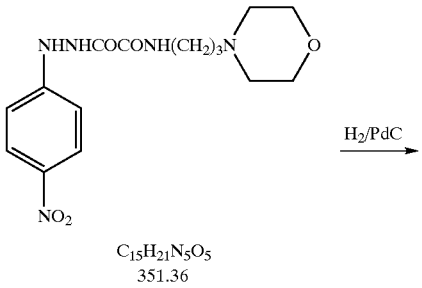

-continued

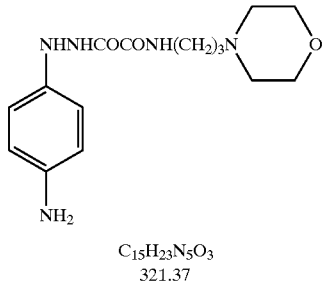

Step 4: Preparation of 3-chloroacetamido-2,4-dimethyl-N-(4-[3-morpholino-propylcarbamoylcarbonylhydrazino]phenyl)benzenesulfonamide hydrochloride

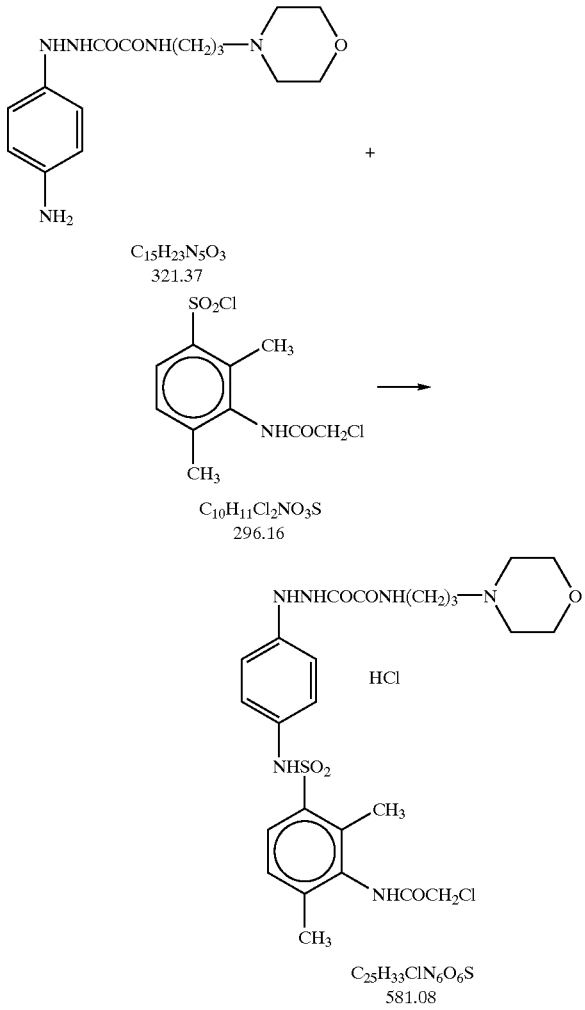

Step 5: Preparation of 1,6-dipyrid-3-ylamidohexane

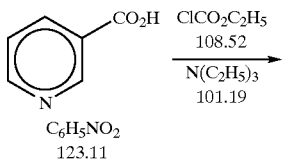

-continued

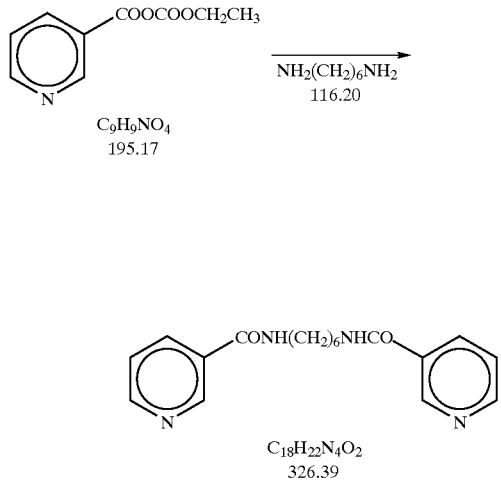

Step 6: Preparation of 2,6-dimethyl-3-(4-[3-morpholinopropylcarbamoyl-carbonylhydrazino]-phenylsulfamoyl)phenylcarbamoylmethyl 3-(6-Pyrid-3-ylamido hexamethylenecarbamoyl)pyridinium chloride hydrochloride. (M1).

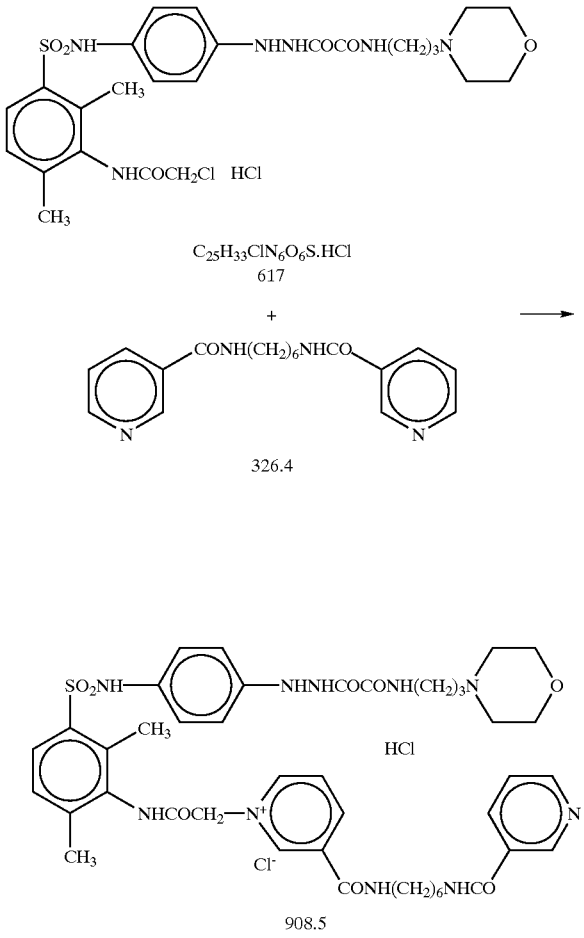

EXAMPLE 2

Preparation of Nucleating Agent (M13) of formula (1) and (N8) of formula (II)

Analogously with the above preparation, the following synthetic route for the preparation of the nucleator (M13), is illustrative for the nucleators for this invention of formula (B):

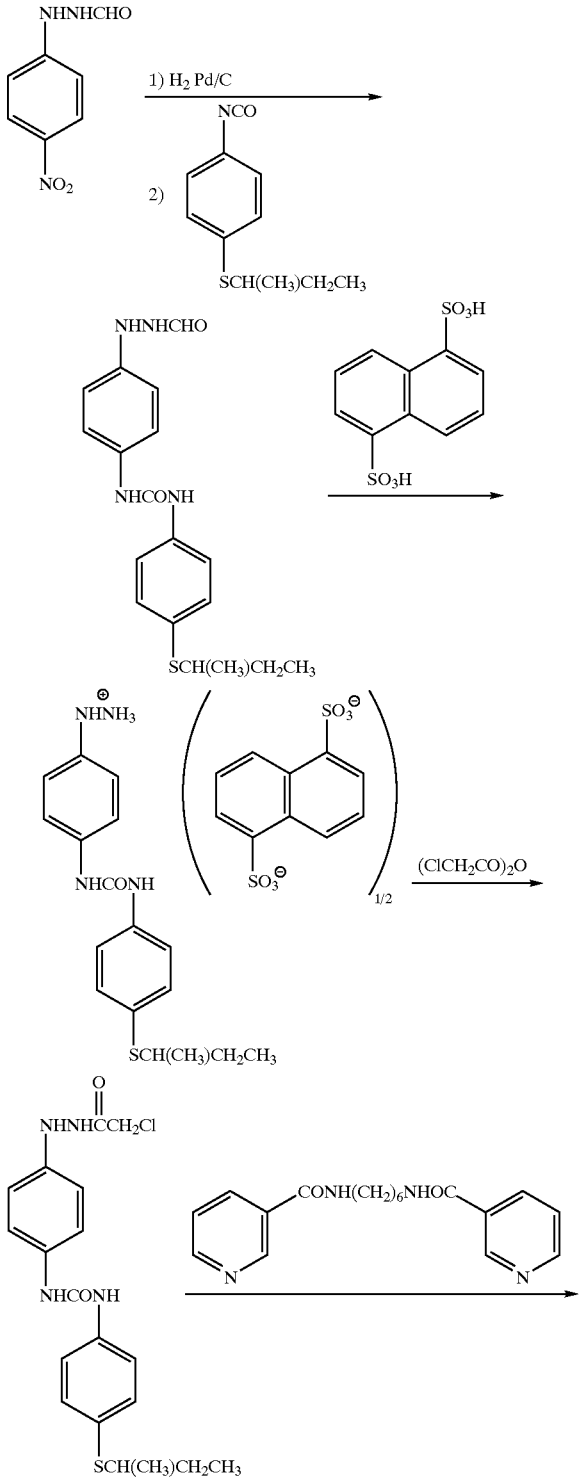

-continued
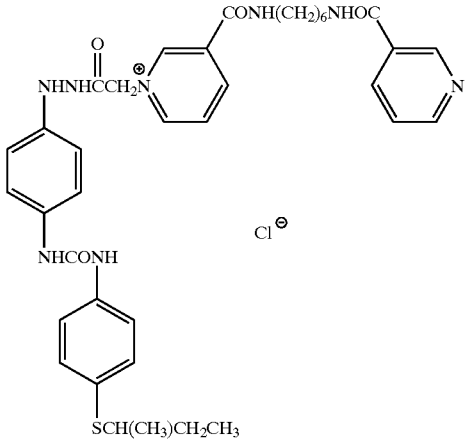
(M13)
This synthesis also produces the dimeric molecule (N8).
EXAMPLE 3
Preparation of Nucleating Agent (M15) of Formula (I)
Analogously, the following synthetic route for the preparation of nucleator (M15) is illustrative for the nucleators of this invention of formula (C):
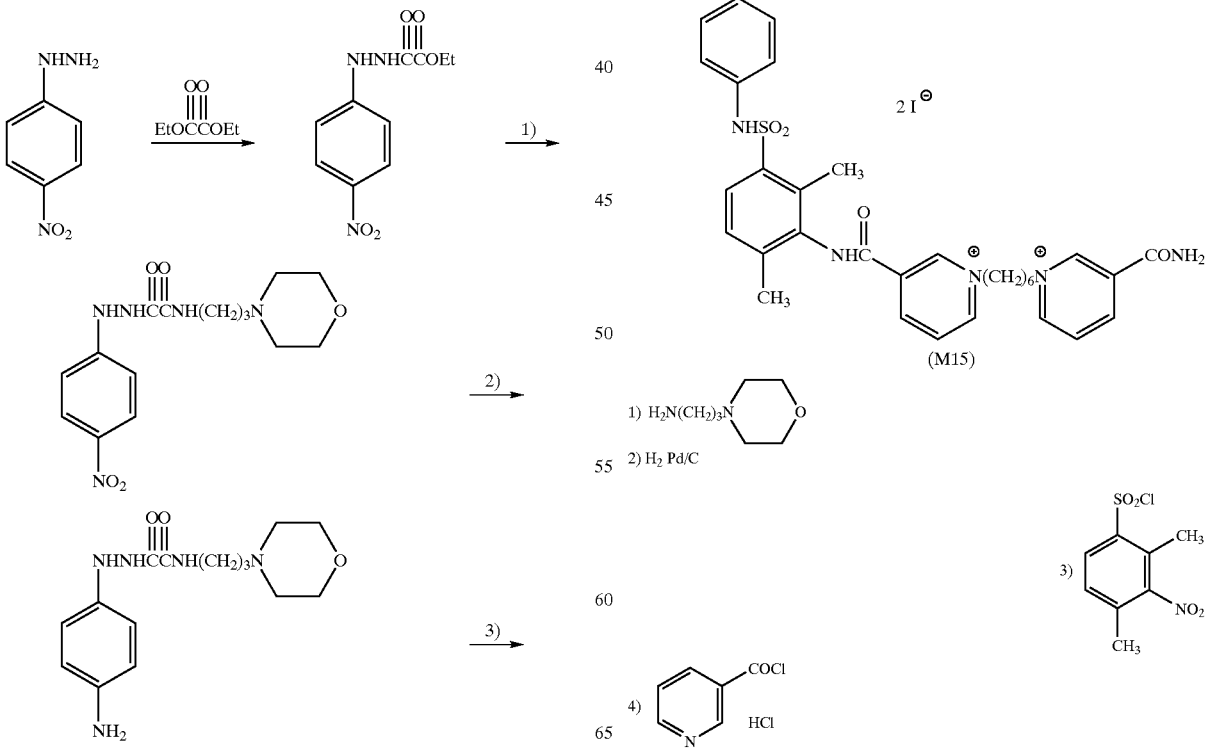
-continued
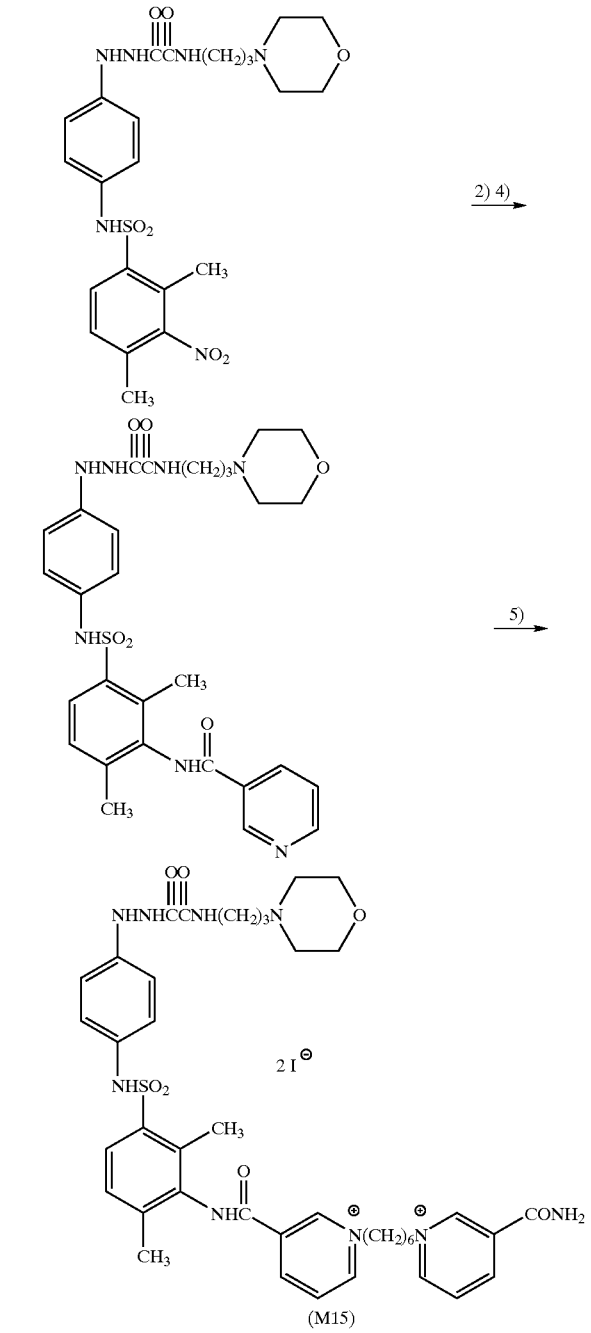
(M15)

-continued

5) 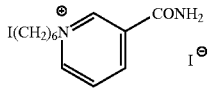

No compound of formula (II) is prepared in this synthesis.

EXAMPLE 4

Preparation of Nucleating Agent (1–6) of formula (III)

The following synthesis is typical of those hydrazide nucleating agents including both a thio group and a group comprising at least three ethyleneoxy units.

Step 1. Preparation of Tetraethyleneglycol Mono-octyl Ether

Tetraethyleneglycol (1243 g, 6.40 mol) was heated at 100C. for 30 min with stirring and vigorous nitrogen bubbling, then cooled to 60C. A 50% NaOH solution (70.4 g, 0.88 mol) was added and the resulting solution was heated at 100–105C. for 30 min with nitrogen bubbling. The solution was cooled to 60C., bromooctane (154 g, 0.80 mol) added, and the reaction heated at 100–110C. for 24 h. The reaction solution was cooled, added to ice water and extracted twice with methylene chloride. The combined extracts were washed with 10% NaOH, water and brine, dried, treated with charcoal, and filtered through a thin silica gel pad. The solvent was removed in vacuo; the residual product (155 g, 63%) was a pale yellow oil.

Step 2. Preparation of Octyloxytetraethyleneoxy Methanesulfonate

A solution of tetraethyleneglycol mono-octyl ether (61.3 g, 0.20 mol), 4-dimethylaminopyridine (1.2 g, 0.01 mol), N,N-diisopropylethylamine (41.9 ml, 0.24 mol), and dry methylene chloride (500 ml) was cooled to OC in an icebath. Methanesulfonyl chloride (18.6 ml, 0.24 mol) was added over a 30 min period at 0C and the reaction was stirred at 0C for 30 min and at room temperature for 4 h. The reaction mixture was added to ice water containing 10 ml conc. HCl, the organic layer was separated and the aqueous layer extracted with methylene chloride. The combined extracts were washed with 10% NaOH, water and brine, dried, treated with charcoal, and filtered through a thin silica gel pad. The solvent was removed in vacuo giving the residual product (51.1 g, 66%) as a golden yellow oil.

Step 3. Preparation of Octyloxytetraethyleneoxy Thiol

A solution of octyloxytetraethyleneoxy methanesulfonate (38.5 g, 0.10 mol), thiourea (9.1 g, 0.12 mol) and ethanol (200 ml) was refluxed under a nitrogen atmosphere for 24 h. The reaction was cooled, 50% NaOH (19.2 g, 0.24 mol) and water (20 ml) were added, and the reaction was refluxed with stirring for 1 h. The reaction was cooled in an ice bath, acidified with conc. HCl (20 ml), filtered and the solvent removed in vacuo. The residue was redissolved in ethyl acetate and water. The organic layer was separated and the aqueous layer extracted with ethyl acetate. The combined extracts were washed with water and brine, dried, treated with charcoal and filtered through a thin silica gel pad. The solvent was removed in vacuo giving the residual product (29.1 g, 90%) as a colourless oil.

Step 4. Synthesis of 3-chloroacetamido-2,4-dimethylbenzene Sulfonyl Chloride

To chlorosulfonic acid (75 ml, 1.15 mol) was added with stirring solid 2-chloro-N-(2,6-dimethylphenyl) acetamide over a 30 min period at 25–30C and the reaction mixture was stirred at 60–65C. for 1.5 h. The reaction was cooled, added to ice and extracted with ethyl acetate/methyl ethyl ketone. The combined extracts were washed with water and brine, dried and the solvent removed in vacuo giving the residual product (61.4 g, 69%) as a white solid, m.p. 147.5–149C.

Step 5. Synthesis of 1-formyl-2-(4-(3-chloroacetamido-2,4-dimethyl-sulfonamido)phenyl) hydrazide A mixture of 1-formyl-2-(4-nitrophenyl) hydrazide (33.6 g, 0.185 mol), dry N,N-dimethylacetamide (200 ml) and 10% Pd/C catalyst was hydrogenated at 345 kPa (50 ps) over a 6 h period to the corresponding amine. The reaction mixture was dried, filtered, cooled to 0C. and N,N-di-isopropyl-ethylamine (32.3 ml, 0.185 mol) was added. A solution of 3-chloroacetamido-2,4-dimethylbenzenesulfonyl chloride (54.8 g, 0.185 mol) and dry N,N-dimethyl-acetamide (200 ml) was added over a 30 min period at 0C and the reaction was stirred at room temperature for 18 h. The reaction mixture was added to ice water, the separated solid was filtered, washed with water, ether and heptane, stirred with hot aqueous acetonitrile, cooled and filtered. The product (61.1 g, 80%) was a white solid, m.p. 211–212C. (dec).

Step 6. Preparation of Compound 1–6 of Formula (III)

A solution of octyloxytetraethyleneoxy thiol (10.6 g, 0.033 mol) and dry N,N-dimethylformamide (50 ml) was cooled to 15C. An 80% NaH dispersion (1.00 g, 0.33 mol) was added in portions over a 10 min period and the mixture was stirred at room temperature for 30 min. A solution of 1-formyl-2-(4-(3-chloroacetamido-2,4-dimethylsulfon-amido)phenyl) hydrazide (12.3 g, 0.030 mol) and dry N,N-dimethylformamide (50 ml) was added over a 1.5 h period and the reaction was stirred at room temperature for 18 h. The reaction mixture was added to ice water containing formic acid (2 ml) and the mixture was extracted with ethyl acetate. The combined extracts were washed with water and brine, dried and the solvent removed in vacuo. The residue was purified by chromatography on silica gel and recrystallized twice from ethyl acetate. The product (6.5 g, 31%) was a white, waxy solid, m.p. 140–141C.

EXAMPLE 5

Preparation of Nucleating Agent (J-6) of Formula (III)

The following synthesis is typical of those hydrazide nucleating agents including a pyridinium group.

A solution of 1-formyl-2(4-nitrophenyl) hydrazine (5.4 g, 0.03 mol) in 50 ml N,N-dimethylacetamide was reduced by contact for 1 h at elevated pressure and in the presence of a Pd/C catalyst with hydrogen and the resulting product was dried and filtered. The filtrate was stirred at ice temperature while 3.9 g (0.03 mol) N,N-di-isopropylethylamine was added, followed by 9.8 g (0.03 mol) 2,4-dimethyl-3-(chloroacetamido) benzenesulfonyl chloride. The resulting solution was allowed to warm to room temperature and stand for 15 h before being dripped into 500 ml water, so that solid separated. The solid was collected, washed with water and digested for 1 h at 60C with 100 ml acetonitrile to give 9.7 g (79% yield) of intermediate product with a melting point of 210–211C. A mixture of 10 g of this intermediate, 12 ml 4-(1-butylpentyl)pyridine and 20 ml N,N-dimethylacetamide was warmed on a steam bath for 1 h, cooled, dropped into 400 ml ether and the solid was collected, washed well with ether, and dried. Upon being dissolved in a minimum volume of methanol and dropped into 400 ml ether with stirring, the yield was 14.3 g (94% yield) of hydrazide 1–6.

EXAMPLE 6

Preparation of Coatings

The film coating prepared consisted of a polyethylene terephthalate (ESTAR™) support, an antihalation layer on the back of the support on which was coated a latent image forming emulsion layer, a gel interlayer and a protective supercoat.

The latent image forming emulsion layer consisted of a 70:30 chlorobromide cubic (monodispersed emulsion (0.18 μm edge length) uniformly doped with a rhodium salt at 0.109 mg/Ag mol and an iridium salt at 0.265 mg/Ag mol. It was then chemically sensitised with sulfur and gold and spectrally sensitised with 400 mg/Ag mol of sensitising dye of the formula:

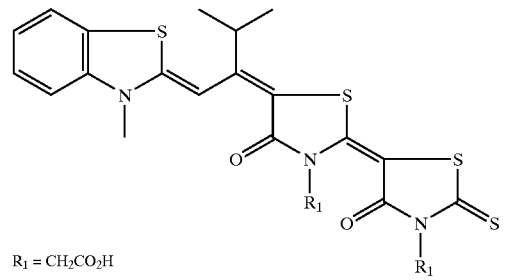

$R_1 = CH_2CO_2H$

The emulsion was coated at a laydown of 3.3 g Ag/m$^2$ in a vehicle of 2.5 g/m$^2$ gel and 0.55 g/m$^2$ latex copolymer of methyl acrylate, the sodium salt of 2-aciylamido-2-methylpropane sulfonic acid and 2-(methacryloyloxy)ethyl-acetoacetate (88:5:7 by weight). Other addenda included 2-methylthio-4-hydroxy-5-carboxy-6-methyl-1,3,3a,7-tetraazaindene, 2-methylthio-4-hydroxy-6-methyl-1,3,3a,7-tetraazaindene, 1-(3-acetamidophenyl)-5-mercaptotetrazole, 4-carboxy-methyl-4-thiazoline-2-thione and a thickener to achieve the required viscosity. Nucleator I-6 of formula (III) was then added as the final component.

The interlayer was coated at a gel laydown of 0.65 g/m$^2$ and included a nucleating agent comprising a combination of 13% of formula (I) (M1) and 87% of formula (II) (N1) (hereinafter referred to as (M1/N1)) and 60 mg/m$^2$ amine booster (B1). The supercoat contained matte beads and surfactant and was coated at a gel laydown of 1 g/m$^2$.

EXAMPLE 7

Evaluation of Coatings (i) Sensitometric Data

A range of coatings containing nucleating agents (M1/N1) of formula (I)/(II) with (1–6) of formula (III) at varying levels were exposed to a 1 $\mu$s broad band flash exposure with a 5% tint plus a lateral 0.15 wedge and a suitable neutral density filter. The resulting wedge exposure contained a 95% tint with varying densities from the step wedge. Comparisons of the sensitometry for the coatings were made as shown in Table 1.

TABLE 1

| Nuc. I-6 (mg/m$^2$) | Nuc. M1/N1 (mg/m$^2$) | $D_{min}$ | $D_{max}$ | PrD | Sp0.6 | Sp4 | Toe C | USC |
|---|---|---|---|---|---|---|---|---|
| 5 | — | 0.029 | 5.45 | 5.40 | 0.67 | 0.55 | 9.11 | 34.23 |
| 4 | 2.5 | 0.029 | 5.62 | 5.60 | 0.68 | 0.57 | 9.78 | 39.73 |
| 3 | 5.0 | 0.028 | 5.56 | 5.53 | 0.65 | 0.56 | 8.24 | 43.75 |
| 2 | 7.5 | 0.029 | 5.51 | 5.48 | 0.64 | 0.55 | 7.92 | 45.58 |
| — | 8.75 | 0.029 | 5.42 | 5.45 | 0.64 | 0.54 | 8.36 | 42.16 |

In Table I the following abbreviations are used:-
$D_{min}$ - minimum density:
$D_{max}$ - maximum density
PrD - practical density, measured as the density achieved at an exposure 0.4 logE units higher than the Sp0.6 value
Sp0.6 - toe speed, measured as the relative logE exposure required to produce a density of 0.6 above $D_{min}$
Sp4 - measured as the relative logE exposure required to produce a density of 2.0 above $D_{min}$
Toe C - measured as the gradient between density points 0.1 and 0.6 above $D_{min}$
USC - upper scale contrast, measured as the gradient between density points 2.5 and 4.0 above $D_{min}$ (ii) Sensitometric Evaluation From Table 1 it can be seen that any of the nucleator combinations coated could be used to give an acceptable sensitometric results as all of the practical densities achieved were over 5.0 and the speeds were all very similar. The nucleation performance of each of the combinations was also seen to be comparable, shown by a toe contrast value of over 5, once again indicating that any of the combinations could be used satisfactorily in a high contrast material.

(iii) Process Sensitivity Evaluation

The coated samples were processed in two ways.

Firstly, the samples were developed for 5 s in developer A, a conventional hydroquinone-phenidone developer supplied by Eastman Kodak Co. under the trade name MX-1375, including 3.8 g/l sodium bromide and having a pH of 10.45. They were then removed rapidly and immersed for 15 s into developer B, based on MX-1375 but with 8.1 g/l sodium bromide and a reduced pH of 9.9. After this, they were then rapidly removed and placed into the original developer (developer A) for a further 25 s (method 1). The densities of a specific step in the centre of the strip were measured on an X-rite™ densitometer.

As a control position, more samples that had been exposed in the same way were processed for 45 s in developer A with normal agitation (method 2) and these densities were then measured on an X-rite™ densitometer.

The difference in densities between the two methods of processing then gave an idea of the sensitivity of the film to changes in developer pH and bromide content (see Table 2).

TABLE 2

| Nucl. I-6 (mg/m$^2$) | Nucl. M1/N1 (mg/m$^2$) | Density Method 1 | Density Method 2 | Delta Density (Method 1–Method 2) |
|---|---|---|---|---|
| 5 | — | 1.117 | 1.563 | −0.446 |
| 3 | 5.00 | 1.093 | 1.202 | −0.109 |
| 2 | 7.50 | 1.105 | 1.144 | −0.039 |
| — | 8.75 | 0.968 | 0.795 | +0.173 |

Table 2 shows the effect of change in the nucleator combinations on sensitivity to variations in developer pH and bromide level. Using this method of evaluation, if the delta density is between −0.13 and +0.13, processing evenness is visually very good. If the delta density is more negative than −0.13, the processing unevenness is seen as areas of lower density. If the delta density is more positive than +0.13, the processing unevenness is seen as areas of higher density.

The data in Table 2 therefore indicates that if the amount of (M1/N1) is in excess of the amount of I-6 in accordance with the preferred embodiment, the films' sensitivity to variations in the developer pH and bromide level, which occur during development, can be eliminated, leading to good processing evenness, there being very little difference in the density achieved with the two different processing regimes. On their own, (M1/N1) and I-6 were sensitive to the different processing regimes, giving either a positive or negative delta density, resulting in less acceptable processing evenness.

(iv) Developer Latitude Evaluation

Table 3 shows the way in which a combination of nucleators enables a film to achieve good practical density through a developer which would only yield a low density when only one nucleator was used, thereby broadening the range of development conditions through which the film may be processed.

TABLE 3

| Nucleator I-6 mg/m$^2$ | Nucleator M1/N1 mg/m$^2$ | PrD for 20 sec @ 35 C. Developer 1 (MX1735) | PrD for 30 sec@ 35 C. Developer 2 (ND-1) | PrD for 45 sec @ 35 C. Developer 3 (Accumax) |
|---|---|---|---|---|
| 0 | 5 | 5.81 | 4.35 | 4.43 |
| 2 | 5 | 5.79 | 5.25 | 5.19 |
| 4 | 5 | 5.77 | 5.25 | 5.28 |
| 2 | 0 | 4.57 | | 5.08 |

Developer 1 is MX-1735
Developer 2 is ND-1, a conventional hydroquinone-phenidone developer supplied Fuji Photo Film Co. Inc
Developer 3 is Accumax ™, a conventional hydroquinone-phenidone developer supplied by Eastman Kodak Co.

It can be seen that with only M1/N1 present the practical density achieved in Developer 1 was almost 6, whereas in Developer 2 it was only 4.35 and in developer 3 only 4.43, a density of over 5 being desirable. Similarly although the practical density was satisfactory for I-6 alone in Developer 3 it was unsatisfactory for Developer 1. By using a combination of the two nucleators I-6 and M1/N1 in various proportions, good practical density was achieved with each of the developers providing good processing robustness.

The present invention has been described in detail with reference to preferred embodiments. It will be understood by those skilled in the art that variations and modifications can be made within the spirit and scope of the invention.

What is claimed is:

1. An ultrahigh contrast photographic material comprising a support bearing a silver halide emulsion layer, containing a combination of two or more hydrazide nucleating agents in the emulsion layer and/or a hydrophilic colloid layer, characterised in that the combination comprises a nucleating agent(s) of formulae (I) and/or (II) with a nucleator of formula (III), in which the nucleating agent of formula (I) comprises (a) two nicotinamide moieties, which may be the same or different, which are linked by a linking group, and (b) a hydrazide moiety linked to only one of those nicotinamide moieties; the nucleating agent of formula (II) comprises a dimeric molecule comprising two monomers linked by a linking group, each monomer of which (a) may be the same or different and (b) comprises a hydrazide moiety and a nicotinamide moiety; and the nucleating agent of formula (III) comprises an aryl sulfonamido aryl hydrazide.

2. A photographic material as claimed in claim 1 wherein the nucleating agent of formula (I) has one of the formulae:

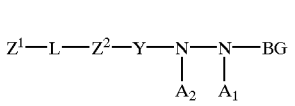

$(T)_n$ or

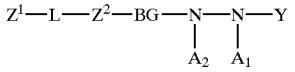

$(T)_n$ wherein BG is a blocking group;

one of $A_1$ and $A_2$ is a hydrogen atom and the other is a hydrogen atom, an acyl group or an alkyl- or aryl-sulfonyl group, any of which groups may be substituted;

$Z^1$ and $Z^2$ are the same or different and each is a nicotinamide residue, at least one of which is positively charged;

Y is a substituted aryl or heterocyclic ring;

L is a linking group;

T is an anionic counterion and n is 1 or 2.

3. A photographic material as claimed in claim 1 wherein the nucleating agent of formula (I) has one of the formulae:

(A)

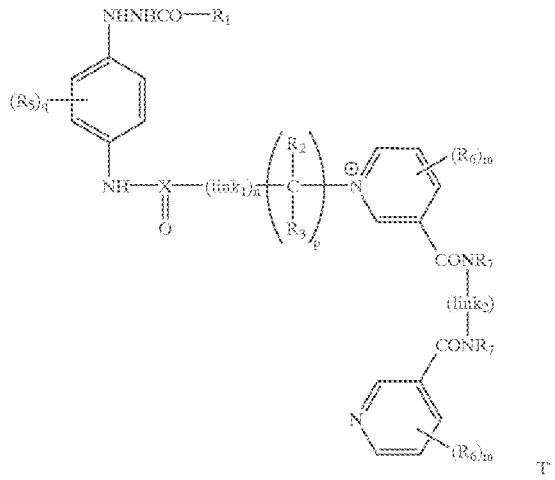

(B)

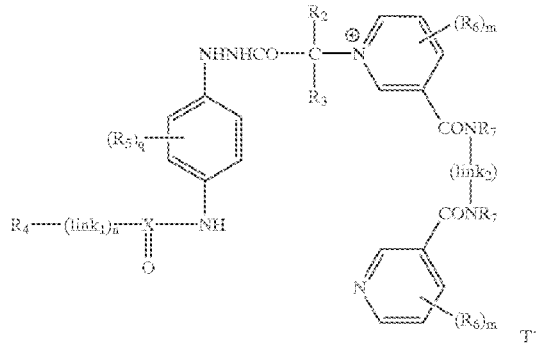

or (C)

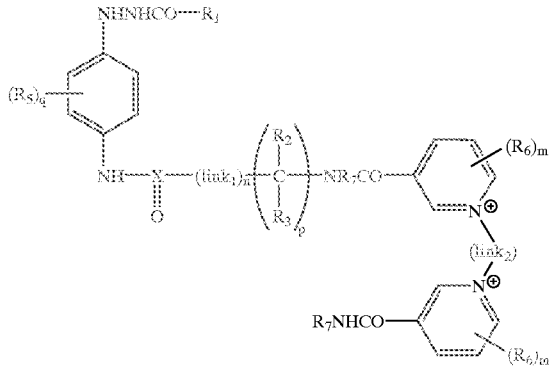

wherein $R_1CO$ comprises a blocking group and $R_1$ is selected from a hydrogen atom, and an unsubstituted or substituted alkyl, aryl, alkoxy, aryloxy, alkoxy- or aryloxy-carbonyl and alkyl- or aryl-aminocarbonyl group; or $R_1$ is or contains an unsubstituted or substituted heterocyclic group, having a 5- or 6-membered ring containing at least one nitrogen, oxygen or sulfur atom, wherein the ring may be linked either directly to the carbonyl group or via an alkyl, alkoxy, carbonyl, amino- or alkylamino-carbonyl group and wherein the ring may be fused to a benzene ring;

$R_2$ and $R_3$ are independently selected from hydrogen and an unsubstituted or substituted alkyl or aryl group and p is 0 or 1;

$R_4$ and each $R_5$ and each $R_6$ are independently selected from hydrogen, halogen, hydroxy, cyano and an unsubstituted or substituted alkyl, aryl, heterocyclyl, alkoxy, acyloxy, aryloxy, carbonamido, sulfonamido, ureido, thioureido, semicarbazido, thiosemicarbazido, urethane, quaternary ammonium, alkyl- or aryl-thio, alkyl- or aryl-sulfonyl, alkyl- or aryl-sulfinyl, carboxyl, alkoxy- or aryloxy-carbonyl, carbamoyl, sulfamoyl, phosphonamido, diacylamino, imido or acylurea group, a group containing a selenium or a tellurium atom, and a group having a tertiary sulfonium structure;

each m is independently an integer from 0 to 4;

q is an integer from 0 to 4;

each $R_7$ is independently selected from hydrogen and an unsubstituted or substituted alkyl or aryl group;

X is selected from C, S═O and C—NH;

$(link_1)$ is a linking group selected from an unsubstituted or substituted alkylene, polyalkylene, aryl, arylaminocarbonyl or heterocyclyl group and n is 0 or 1;

$(link_2)$ is a linking group selected from an unsubstituted or substituted polyalkylene, polyalkylene oxide, polyalkylene containing one or more heteroatoms selected from nitrogen, oxygen and sulfur, separated from each other by alkylene groups, or an unsubstituted or substituted polyalkylene in which the alkylene groups are separated by an unsubstituted or substituted aryl or heterocyclic ring and $T^-$ is an anionic counterion.

4. A photographic material as claimed in claim 3 wherein $R_1$ is the group —$CONH(CH_2)_n$-morpholino, wherein n is 0 to 4.

5. A photographic material as claimed in claim 3 wherein $R_2$ and $R_3$ are independently selected from hydrogen atoms or alkyl groups, $R_4$ and each $R_5$ and each $R_6$ are independently selected from hydrogen, alkyl, alkoxy, alkylthio, trifluoromethyl or methylsulfonamido groups and each $R_7$ is independently selected from hydrogen, an alkyl group or an alkyl group substituted with a dialkylamino group.

6. A photographic material as claimed in claim 3 wherein when X is S═O or C—NH, n is 1 and when X is C, n is 0.

7. A photographic material as claimed in claim 1 wherein the nucleating agent of formula (I) has the formula:

(M1)

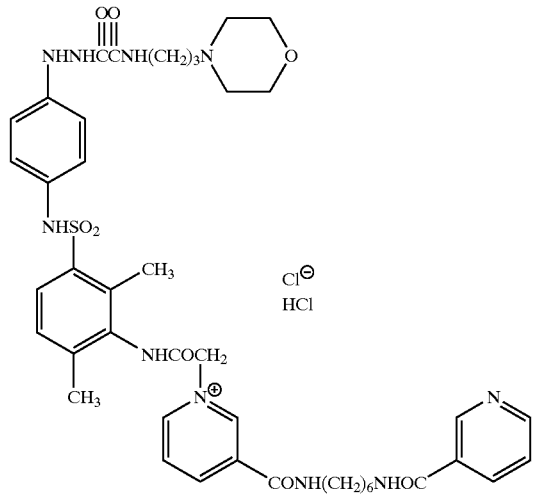

8. A photographic material as claimed in claim 1 wherein the nucleating agent of formula (II) has one of the formulae:

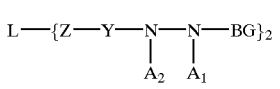

2T or

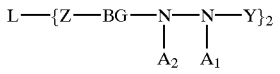

2T wherein each monomer linked by linking group L is the same or different;

BG is a blocking group;

one of $A_1$ and $A_2$ is a hydrogen atom and the other is a hydrogen atom, an acyl group or an alkyl- or aryl-sulfonyl group, any of which groups may be substituted;

Z is a positively charged nicotinamide residue;

Y is a substituted aryl or heterocyclic ring and

T is an anionic counterion.

9. A photographic material as claimed in claim 8 wherein the nucleating agent of formula (II) has one of the formulae:

(D)

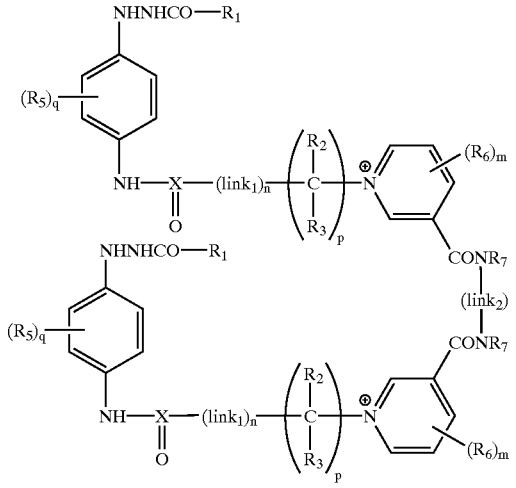

2T (E)

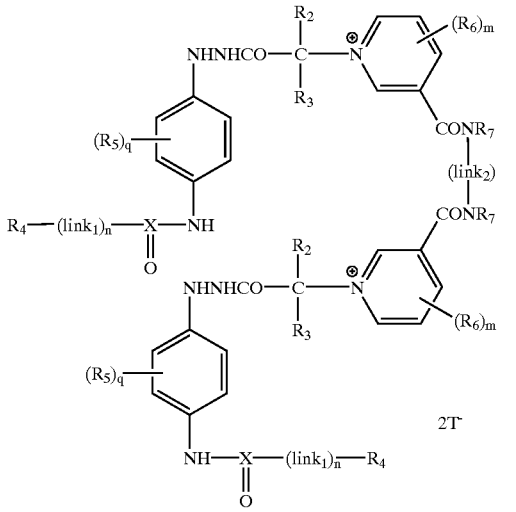

2T

-continued or (F)

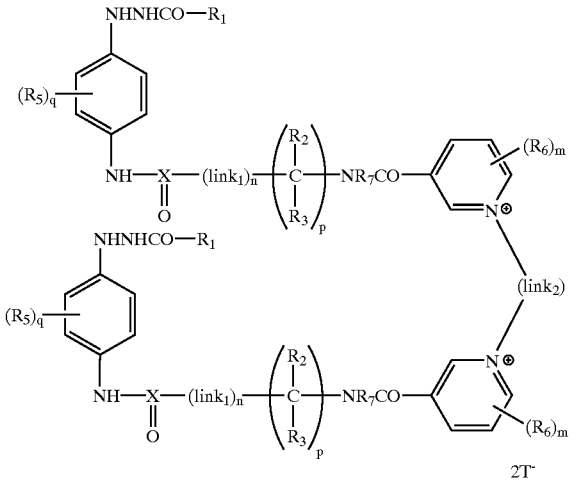

wherein each $R_1CO$ comprises a blocking group and each $R_1$ is independently selected from a hydrogen atom, and an unsubstituted or substituted alkyl aryl, alkoxy, aryloxy, alkoxy- or aryloxy-carbonyl and alkyl- or aryl-aminocarbonyl group; or each $R_1$ independently is or contains an unsubstituted or substituted heterocyclic group, having a 5- or 6-membered ring containing at least one nitrogen, oxygen or sulfur atom, wherein the ring may be linked either directly to the carbonyl group or via an alkyl, alkoxy, carbonyl, amino- or alkylamino-carbonyl group and wherein the ring may be fused to a benzene ring;

each $R_2$ and each $R_3$ is independently selected from hydrogen and an unsubstituted or substituted alkyl or aryl group and each p is independently 0 or 1;

each $R_4$ and each $R_5$ and each $R_6$ is independently selected from hydrogen, halogen, hydroxy, cyano and an unsubstituted or substituted alkyl, aryl, heterocyclyl, alkoxy, acyloxy, aryloxy, carbonamido, sulfonamido, ureido, thioureido, semicarbazido, thiosemicarbazido, urethane, quaternary ammonium, alkyl- or aryl-thio, alkyl- or aryl-sulfonyl, alkyl- or aryl-sulfinyl, carboxyl, alkoxy- or aryloxy-carbonyl, carbamoyl, sulfamoyl, phosphonamido, diacylamino, imido or acylurea group, a group containing a selenium or a tellurium atom, and a group having a tertiary sulfonium structure;

each m is independently an integer from 0 to 4;

each q is independently an integer from 0 to 4;

each R 7is independently selected from hydrogen and an unsubstituted or substituted alkyl or aryl group;

each X is independently selected from C, S═O and C—NH;

each ($link_1$) is a linking group independently selected from an unsubstituted or substituted alkylene, polyalkylene, aryl, arylaminocarbonyl or heterocyclyl group and n is 0 or 1;

($link_2$) is a linking group independently selected from an unsubstituted or substituted polyalkylene, polyalkylene oxide, polyalkylene containing one or more heteroatoms selected from nitrogen, oxygen and sulfur, separated from each other by alkylene groups, or an unsubstituted or substituted polyalkylene in which the alkylene groups are separated by an unsubstituted or substituted aryl or heterocyclic ring and $T^-$ is an anionic counterion.

10. A photographic material as claimed in claim 9 wherein the nucleating agent of formula (II) has the formula:

(N1)

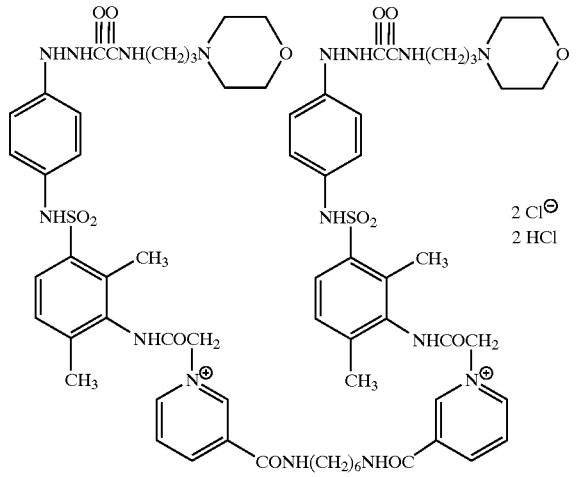

11. A photographic material as claimed in claim 1 wherein the nucleating agent of formula (III) has the formula:

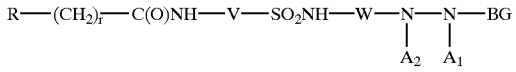

wherein

BG is a blocking group;

one of $A_1$ and $A_2$ is a hydrogen atom and the other is a hydrogen atom, an acyl group or an alkyl- or aryl-sulfonyl group, any of which groups may be substituted;

V and W are independently a substituted or unsubstituted arylene group;

r is 1 to 6; and

R is selected from the class consisting of S—R', wherein R' is an unsubstituted or substituted monovalent group comprising at least three ethyleneoxy units, and a positively charged pyridinium residue substituted with from 1 to 3 unsubstituted or substituted alkyl groups, with its associated cation.

12. A photographic material as claimed in claim 11 wherein the nucleating agent of formula (III) has one of the formulae:

(G)

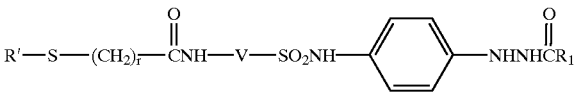

or

-continued (H)

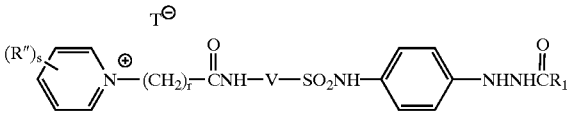

wherein $R_1$ is selected from a hydrogen atom, and an unsubstituted or substituted alkyl, aryl, alkoxy, aryloxy, alkoxy- or aryloxy-carbonyl and alkyl- or aryl-aminocarbonyl group; or $R_1$ is or contains an unsubstituted or substituted heterocyclic group, having a 5- or 6-membered ring containing at least one nitrogen, oxygen or sulfur atom, wherein the ring may be linked either directly to the carbonyl group or via an alkyl, alkoxy, carbonyl, amino- or alkylamino-carbonyl group and wherein the ring may be fused to a benzene ring;

V is an unsubstituted or substituted phenylene or naphthalene group, R' is an unsubstituted or substituted monovalent group comprising at least three ethyleneoxy units, R" is an unsubstituted or substituted alkyl group, r is 1 to 6, s is 1 to 3 and $T^-$ is an anionic counterion.

13. A photographic material as claimed in claim 12 wherein in the nucleating agent of formula (III), (G), $R_1$ is hydrogen, V is a phenylene group substituted with 2,4-dimethyl groups, r is 1 and R' is the group n—$C_8H_{17}$—$(OCH_2CH_2)_4$—.

14. A photographic material as claimed in claim 1 which also contains, in the emulsion layer or a hydrophilic colloid layer, a booster compound.

15. A photographic material as claimed in claim 1 wherein the total amount of nucleating agent of formula (I) and/or formula (II) is from about 0.3 $\mu$mol/m$^2$ to 70 $\mu$mol/m$^2$ and the amount of nucleating agent of formula (III) is from about 0.14 $\mu$mol/m$^2$ to 70 $\mu$mol/m$^2$.

16. A photographic material as claimed in claim 1 wherein the ratio of the amount of a nucleating agent of formula (I) and/or (II): a nucleating agent of formula (III) is greater than 1.0.

17. A photographic material as claimed in claim 1 wherein a nucleating agent of formula (I) is in combination with a nucleating agent of formula (II) and a nucleating agent of formula (III).

18. A photographic material as claimed in claim 17 wherein the amount of compound of formula (II) is greater than the amount of formula (I) and the relative proportion of compound of formula (II) to formula (I) is from about 90:10 to about 70:30.

19. A process of forming a photographic image having ultrahigh contrast which comprises imagewise exposing a photographic material comprising a support bearing a silver halide emulsion layer and processing it with an alkaline developer solution, characterised in that it is developed in the presence of a combination of two or more hydrazide nucleating agents, comprising a nucleating agent of formula (I) and/or (II) with a nucleating agent of formula (III) in which the nucleating agent of formula (I) comprises (a) two nicotinamide moieties, which may be the same or different, which are linked by a linking group, and (b) a hydrazide moiety linked to only one of those nicotinamide moieties; the nucleating agent of formula (II) comprises a dimeric molecule comprising two monomers linked by a linking group, each monomer of which (a) may be the same or different and (b) comprises a hydrazide moiety and a nicotinamide moiety; and the nucleating agent of formula (III) comprises an aryl sulfonamido aryl hydrazide.

20. A process as claimed in claim 19 wherein the photographic material is developed in the presence of a booster compound.

* * * * *